US007625065B2

(12) United States Patent
Kanda et al.

(10) Patent No.: US 7,625,065 B2
(45) Date of Patent: Dec. 1, 2009

(54) INK JET PRINT HEAD AND INK JET PRINTING APPARATUS

(75) Inventors: Hidehiko Kanda, Yokohama (JP); Toshiyuki Chikuma, Kawasaki (JP); Jiro Moriyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 412 days.

(21) Appl. No.: 11/760,442

(22) Filed: Jun. 8, 2007

(65) Prior Publication Data

US 2007/0285463 A1 Dec. 13, 2007

(30) Foreign Application Priority Data

Jun. 12, 2006 (JP) ..... 2006-162418

(51) Int. Cl.
*B41J 2/205* (2006.01)

(52) U.S. Cl. ..... 347/43; 347/15

(58) Field of Classification Search ..... 347/12, 347/15, 40, 43

See application file for complete search history.

(56) References Cited

U.S. PATENT DOCUMENTS 6,325,489 B2 * 12/2001 Endo ..... 347/43
6,729,710 B2 5/2004 Chikuma et al.
6,874,860 B2 * 4/2005 Lahut et al. ..... 347/13
6,877,833 B2 * 4/2005 Teshigawara et al. ..... 347/15
6,896,357 B2 5/2005 Murakami et al.
7,300,137 B2 11/2007 Yamanaka et al.
2006/0050107 A1 3/2006 Yamanaka et al.
2008/0036818 A1 2/2008 Yamanaka et al.

FOREIGN PATENT DOCUMENTS

JP 2003-127439 A 5/2003
JP 2004-82639 A 3/2004
JP 2006-76010 A 3/2006

* cited by examiner

*Primary Examiner*—Lamson D Nguyen
(74) *Attorney, Agent, or Firm*—Fitzpatrick, Cella, Harper & Scinto

(57) ABSTRACT

The present invention provides an ink jet print head that allows for a fast printing of high-density, high-quality images without increasing cost and size of the print head. To this end, the ink jet print head has orifices for ejecting ink of a first volume and orifices for ejecting ink of a second volume, the second volume being smaller than the first volume. Further, the number of orifices for first-volume ink per unit length is greater than the number of orifices for second-volume ink per unit length.

5 Claims, 26 Drawing Sheets

| QUANTIZATION LEVEL | | INK VOLUME APPLIED TO PIXEL FORMING AREA | CYAN IMAGE DENSITY |
|---|---|---|---|
| PRIOR ART USING PRINT HEAD 10 | FIRST EMBODIMENT | | |
| 1 | 1 | 2 (pl) | ABOUT 0.10 |
| 2 | 2 | 10 (pl) | ABOUT 0.30 |
| 3 | – | 14 (pl) | ABOUT 0.40 |
| – | 3 | 22 (pl) | ABOUT 0.55 |
| – | – | 26 (pl) | ABOUT 0.55 |

FIG.8

| QUANTIZATION LEVEL | | INK VOLUME APPLIED TO PIXEL FORMING AREA | CYAN IMAGE DENSITY |
|---|---|---|---|
| COMPARISON EXAMPLE USING PRINT HEAD 40 | FOURTH EMBODIMENT | | |
| 1 | 1 | 0.5(pl) | ABOUT 0.05 |
| 2 | 2 | 2(pl) | ABOUT 0.10 |
| 3 | 3 | 10(pl) | ABOUT 0.30 |
| 4 | – | 13.0(pl) | ABOUT 0.40 |
| – | 4 | 22.5(pl) | ABOUT 0.55 |
| – | – | 26(pl) | ABOUT 0.55 |

FIG.18

| QUANTIZATION LEVEL FOR YELLOW | INK VOLUME APPLIED TO PIXEL FORMING AREA | YELLOW IMAGE DENSITY |
|---|---|---|
| 1 | 10 (pl) | ABOUT 0.8 |
| 2 | 20 (pl) | ABOUT 1.3 |
| - | 22 (pl) | ABOUT 1.3 |

FIG.24

INK JET PRINT HEAD AND INK JET PRINTING APPARATUS

BACKGROUND OF THE INVENTION

1. Field of the Invention

The present invention relates to an ink jet print head having a plurality of ink ejection orifices capable of ejecting ink droplets and to an ink jet printing apparatus using the ink jet print head to perform printing.

2. Description of the Related Art

Printing apparatus are being used as an image outputting device in printers, copying machines and facsimiles, or as an image outputting device for composite electronic devices including computers and word processors and for workstations. Commonly known printing apparatus may be classified into an ink jet type, a wire dot type, a thermal type and a laser beam type. Of these, the ink jet type printing apparatus (ink jet printing apparatus), that performs printing by ejecting ink droplets from an ink jet print head onto a print medium, has many advantages over other types. The advantages of the ink jet printing apparatus include, for example, being able to form highly defined images easily and at high speed, to operate with a high level of quietness, to be constructed in small size and at low cost and to form color images easily. An ink jet print head used in the ink jet printing apparatus has a plurality of ink ejection elements formed therein at high density for faster printing speed and improved image quality. The ink ejection elements each comprise an ink ejection orifice formed in a front face of the print head, a liquid path communicating with the ink ejection orifice, and an electrothermal transducer (heater) installed in the liquid path. A large number of such ink ejection elements are arranged at high density. An ink jet printing apparatus that produces a color image generally has a plurality of such print heads.

The quality of images printed by the ink jet printing apparatus is greatly influenced by the construction of the ink jet print head (for example, the density of ink ejection elements). Thus, in addition to increasing the density of the ink ejection elements, as described above, various measures are currently being taken, for example, in the arrangement of ink ejection orifices (hereinafter merely referred to as orifices) and the volume of ink droplets ejected from the orifices. As one example, Japanese Patent Laid-Open No. 2003-127439 discloses an ink jet print head that can eject two kinds of ink droplets of different volumes from different orifices.

The ink jet print head disclosed in Japanese Patent Laid-Open No. 2003-127439 has a greater number of orifices for ejecting small-volume ink droplets than that of orifices for large-volume ink droplets. These orifices are arranged such that centers of orifices for small-volume ink droplets are located on imaginary lines running through centers of orifices for large-volume ink droplets in the direction of scan of the print head. This arrangement reduces density variations appearing as lines in printed images, assuring the printing of high quality images. That is, by setting the number of orifices for ejecting small-volume ink droplets greater than that of orifices for large-volume ink droplets, the image quality is improved in low-density (low gradation level) areas of the printed image.

Where an ink jet print head disclosed in Japanese Patent Laid-Open No. 2003-127439 is used, a faded image may be produced when high-density image areas fail to be printed at sufficiently high levels of density because the number of orifices for ejecting large-volume ink droplets is small. To prevent such image density reductions, the number of ink droplets applied to a unit area needs to be increased as by increasing the number of printing scans performed to complete a defined image area or reducing a speed at which to scan the print head. This makes it difficult to perform printing at high speed while keeping the high-density areas in good print quality. Further, to be able to perform the high-quality printing at high speed using the conventional ink jet print heads including the one disclosed in Japanese Patent Laid-Open No. 2003-127439, the number of orifices and the number of orifice arrays may be increased. This method, however, increases the size of a semiconductor board that integrates ink-ejection energy generation means (for example, ink-ejecting electrothermal transducers), giving rise to another problem of increased cost and size of the ink jet print head.

SUMMARY OF THE INVENTION

The present invention has been accomplished to solve the above problems and is intended to provide an ink jet print head capable of printing high-density, high-quality images at high speed without increasing the cost and size of the print head.

To solve the above problems, this invention has the following construction.

When viewed from a first aspect the present invention provides an ink jet print head having a plurality of orifices to eject ink of the same color and of different volumes, comprising: a first orifice group comprised of arrayed orifices to eject ink of a first volume; and a second orifice group comprised of arrayed orifices to eject ink of a second volume, the second volume being smaller than the first volume; wherein the number of orifices per unit length in the first orifice group is greater than the number of orifices per unit length in the second orifice group.

Another aspect of the present invention provides an ink jet printing apparatus that prints on a print medium by using the ink jet print head described above.

With this invention, since the orifices for ejecting largest-volume ink are provided in a greater number per unit length in the print head scan direction than any other orifices, high-density, high-quality images can be printed with fewer scans. Compared with the conventional print heads, the print head of this invention does not need to increase the number of orifices, thus preventing a possible increase in cost and size of the print head.

Further features of the present invention will become apparent from the following description of exemplary embodiments (with reference to the attached drawings).

BRIEF DESCRIPTION OF THE DRAWINGS

FIG. 8 shows a relation between a volume of ink applied to a 600×600-dpi pixel forming area according to the associated quantization level (1-3) and a density (optical density) of an image formed, for both the conventional print head 10 and the print head 100 of the first embodiment;

FIG. 18 shows a relation between a volume of ink applied to a pixel forming area according to the associated quantization level and a density of an image formed, for both the print head of FIG. 14 and the print head of the fourth embodiment;

FIG. 24 shows a relation between a yellow ink volume applied to an image forming area according to a quantization level 1, 2 and an image density when a 1-pass printing is executed using the print head of the sixth embodiment of this invention;

DESCRIPTION OF THE EMBODIMENTS

Now, embodiments of this invention will be described in detail by referring to the accompanying drawings.

Ink jet printing apparatus in the embodiments are so-called serial type ink jet printing apparatus that perform a main scan, in which an ink jet print head ejects ink as it travels in a main scan direction, and a subscan, in which a print medium is fed in a subscan direction crossing the main scan direction.

Figure 1:
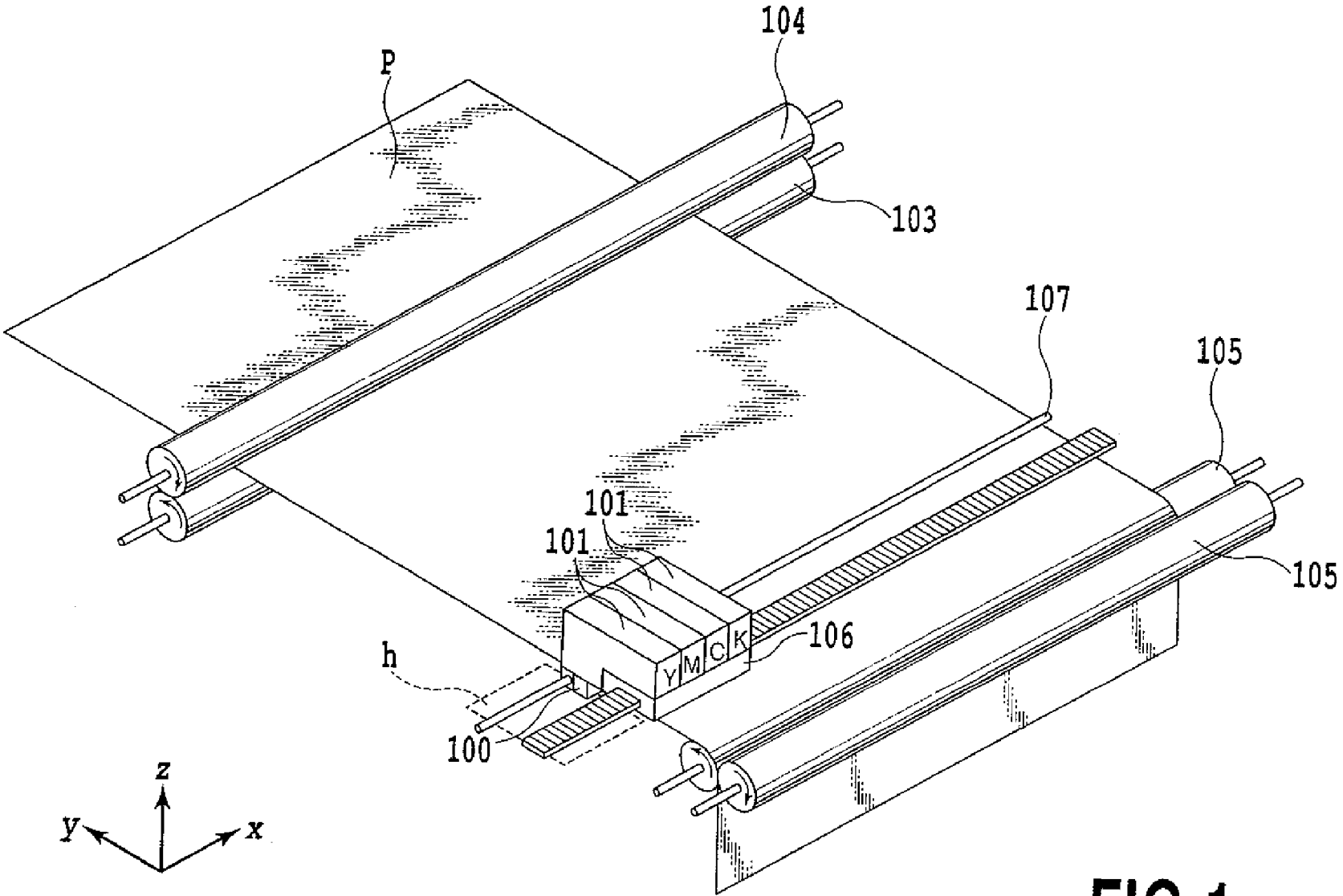
FIG. 1 is a schematic perspective view of an ink jet printing apparatus applied to an embodiment of this invention.

FIG. 1 is a perspective view showing an outline construction of essential portions of the serial type ink jet printing apparatus. In the figure, reference number 101 represents a head cartridge. The head cartridge 101 comprises ink tanks each containing one of a plurality of color inks and a single ink jet print head 100 having a plurality of orifices to eject these inks. In this example, four ink tanks are provided containing four color inks, black (K), cyan (C), magenta (M) and yellow (Y), respectively. The print head in this embodiment, as detailed later, has a plurality of kinds of orifices that eject ink droplets of different volumes. Denoted 103 is a transport roller that is rotated by a drive motor not shown. This transport roller 103, in cooperation with an opposing auxiliary roller 104, holds a print medium P and is rotated intermittently in response to a reciprocal motion of a carriage described later, thus feeding the print medium P a predetermined distance in a subscan or transport direction y.

Denoted 105 are a pair of paper feed rollers that feed the print medium P toward the transport roller 103. The paper feed rollers 105 hold the print medium P therebetween and are rotated to transport the print medium P in the subscan direction (y direction), in cooperation with the transport roller 103 and the auxiliary roller 104.

Denoted 106 is a carriage that removably mounts the head cartridge 101. The carriage 106 is reciprocally driven by a carriage motor along a guide shaft 107 arranged in the main scan direction. When a print operation is not performed or during a recovery operation on the print head 100, the carriage 106 stands by at a home position h indicated by a dashed line.

Upon receiving a print operation start command, the carriage 106 that was standing by at the home position h before starting the print operation prints by ejecting ink from a plurality of orifices in the print head 100 as it moves in the x direction. When the print operation based on the print data for one scan is finished, the carriage 106 returns to the home position and then moves in the x direction again to perform printing.

Figure 2:
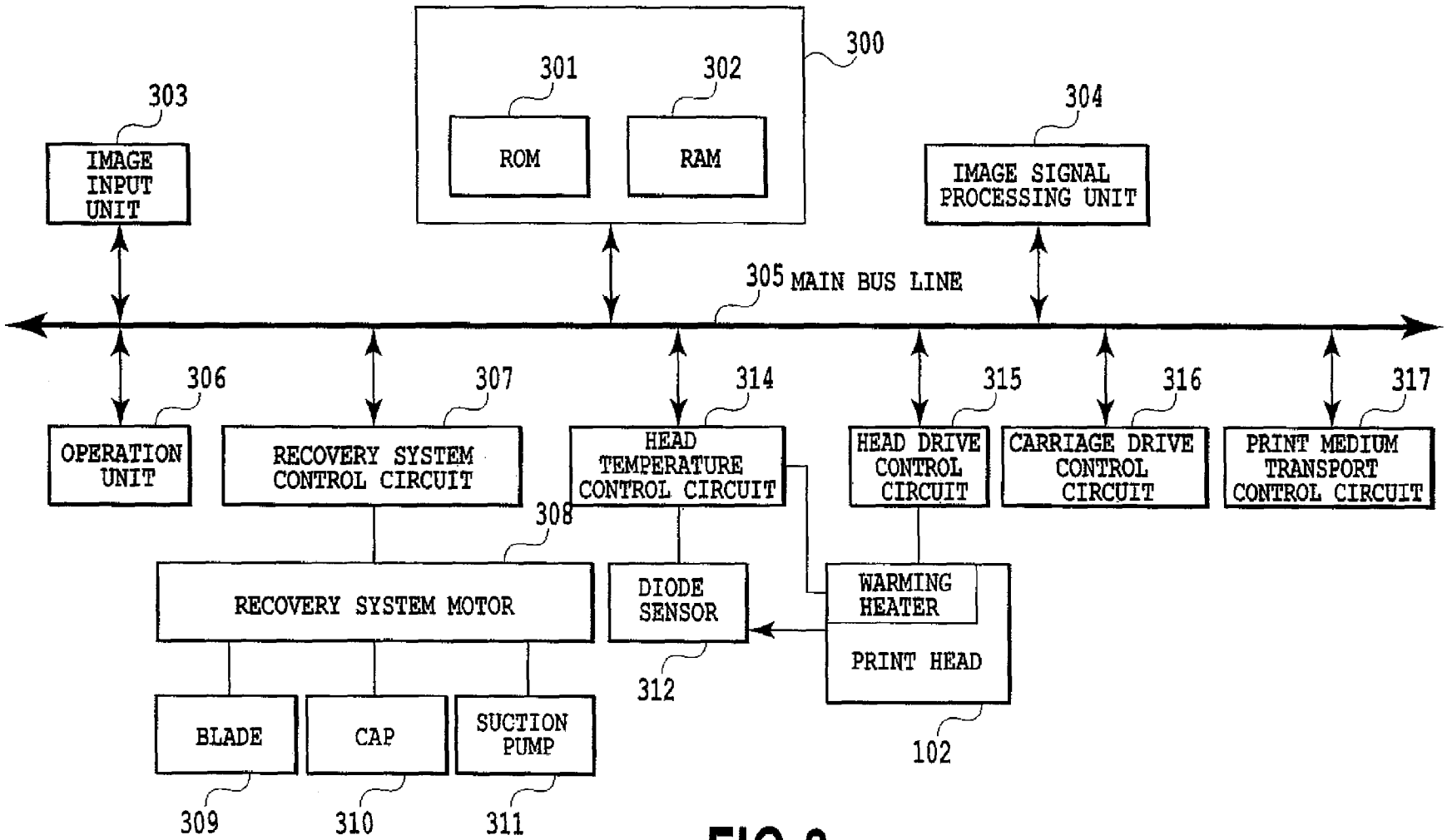
FIG. 2 is a block diagram showing an outline configuration of a control system in the ink jet printing apparatus according to the embodiment of this invention.

FIG. 2 is a block diagram showing an outline configuration of a control system of the ink jet printing apparatus according to the embodiments of this invention. In FIG. 2, a main bus line 305 is connected with software processing means, such as an image input unit 303, an image signal processing unit (CPU) 304 and a central processing unit 300. Further, the main bus line 305 is also connected with hardware processing means, such as an operation unit 306, a recovery system control circuit 307, a head temperature control circuit 314, a head drive control circuit 315, a carriage drive control circuit 316 and a print medium transport control circuit 317. The CPU 300 has a ROM 301 and a RAM 302 and provides the print head 100 with appropriate printing conditions for input information to control the print operation of the print head 100. In the RAM 302 there is installed a program to perform a recovery operation on the print head 100, such as preliminary ejections. This program drives the recovery system control circuit 307 as required to control the operation of the print head, a warming heater and others. A recovery system motor 308 drives the print head 100, a cleaning blade 309 installed at a position opposite the print head 100, a cap 310 and a suction pump 311. The head drive control circuit 315 controls the operation of ejection energy generation elements installed to eject ink from the orifices of the print head 100. The head drive control circuit 315 normally causes the print head 100 to execute preliminary ejections and printing ejections.

In a substrate of the print head 100 where ejection energy generation elements (for example, electrothermal transducers) are installed, there is also a warming heater to heat the ink in the print head 100 to a set temperature. A diode sensor 312 is installed in the substrate to measure a virtual ink temperature in the print head 100.

Next, first to fourth embodiment of the print head 100 used in the ink jet printing apparatus of the above construction will be explained.

First Embodiment

For a multilevel gradation printing, there has been a proposal that uses a plurality of sizes (volumes) of ink droplets landing on a print medium. In the first embodiment of this invention also, the ink jet print head has a construction capable of ejecting two kinds of ink droplets of different volumes. That is, the print head has large orifices L for ejecting large-volume ink droplets and a small ink orifices S for ejecting small-volume ink droplets.

In this specification, a group of arrayed orifices that eject ink droplets of the same color and same volume is called an "orifice group" or "orifice array". For example, a group of ink orifices L is called a large orifice group or large orifice array; and a group of ink orifices S is called a small orifice group or small orifice array.

Figure 12:
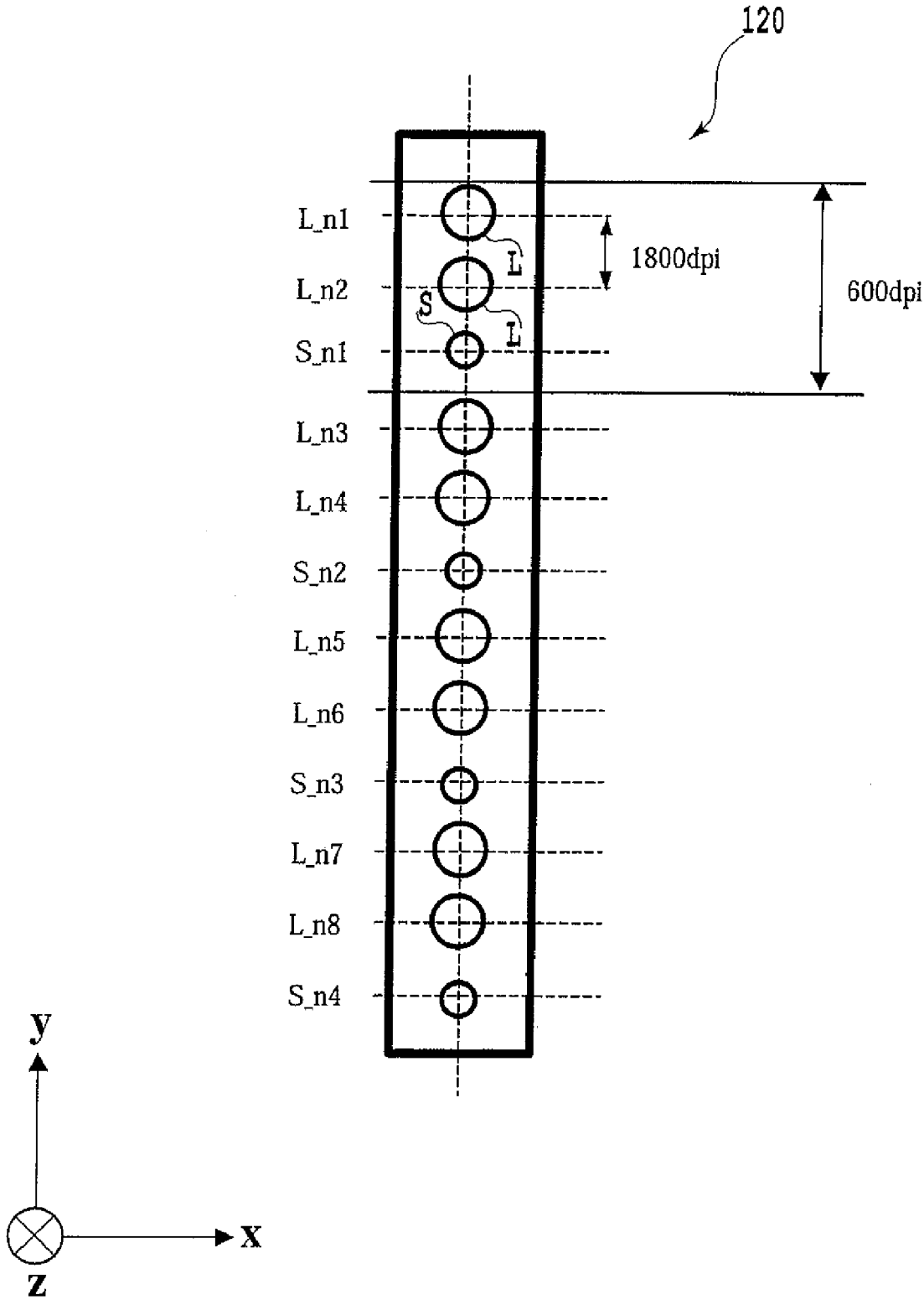
FIG. 12 is a schematic diagram showing a construction of a print head in a third embodiment of this invention.
Figure 20:
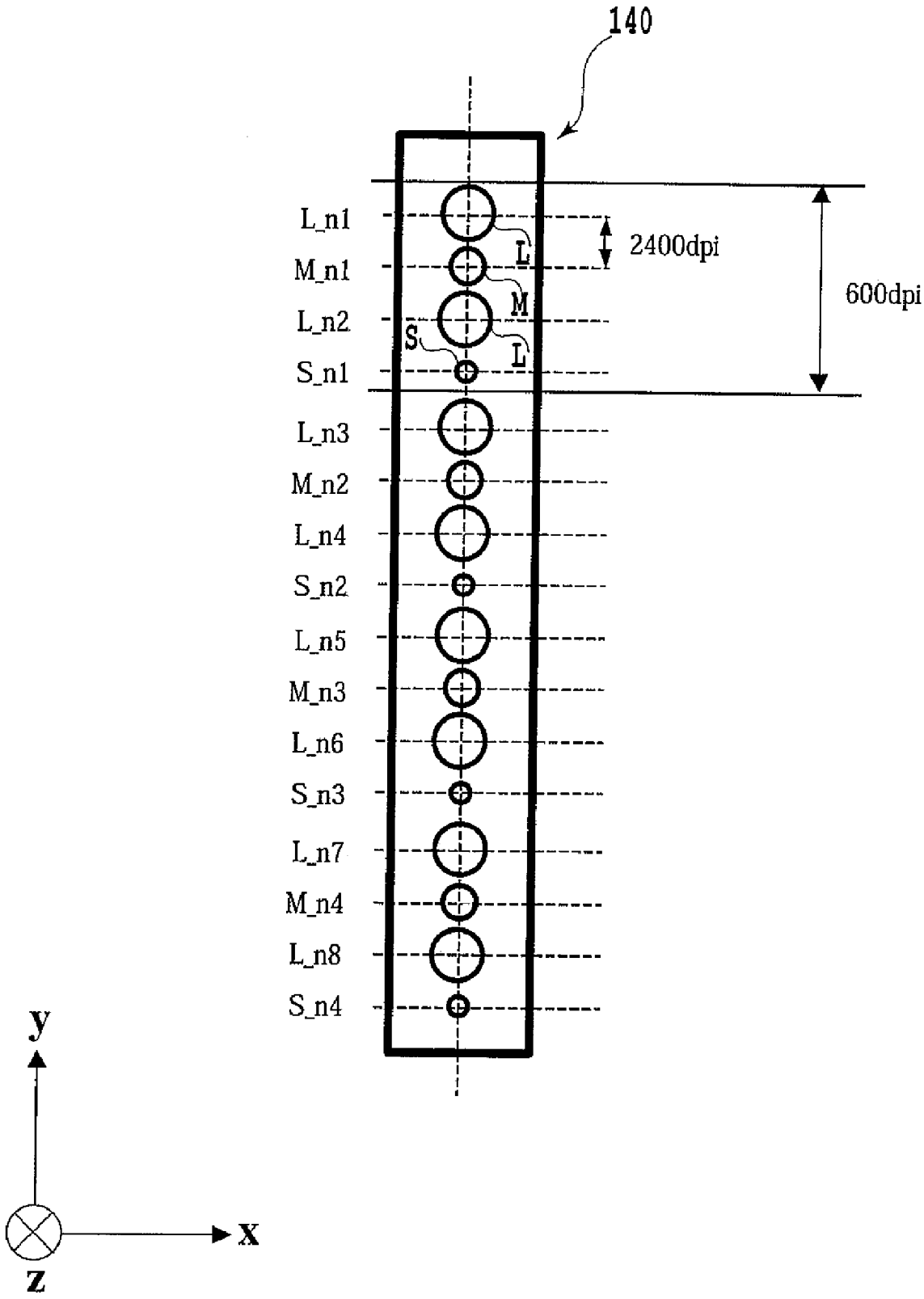
FIG. 20 is a schematic diagram showing a construction of a print head in a fifth embodiment of this invention.

As shown in FIG. 12 and FIG. 20, where orifices for ejecting ink droplets of the same color and same volume are arrayed in line, the array of orifices corresponds to the orifice group. In that case, the orifice group and the orifice array are equivalent. On the other hand, as shown in FIG. 4, FIG. 10, FIG. 15, FIG. 22 and FIG. 26, where orifices for ejecting ink droplets of the same color and same volume are arrayed in a plurality of arrays, a collection of these orifice arrays is called an orifice group. In that case, the orifice group and the orifice array differ.

In the following, the construction of the ink jet print head 100 in the first embodiment will be explained by comparing it with the conventional ink jet print head 10.

Figure 3:
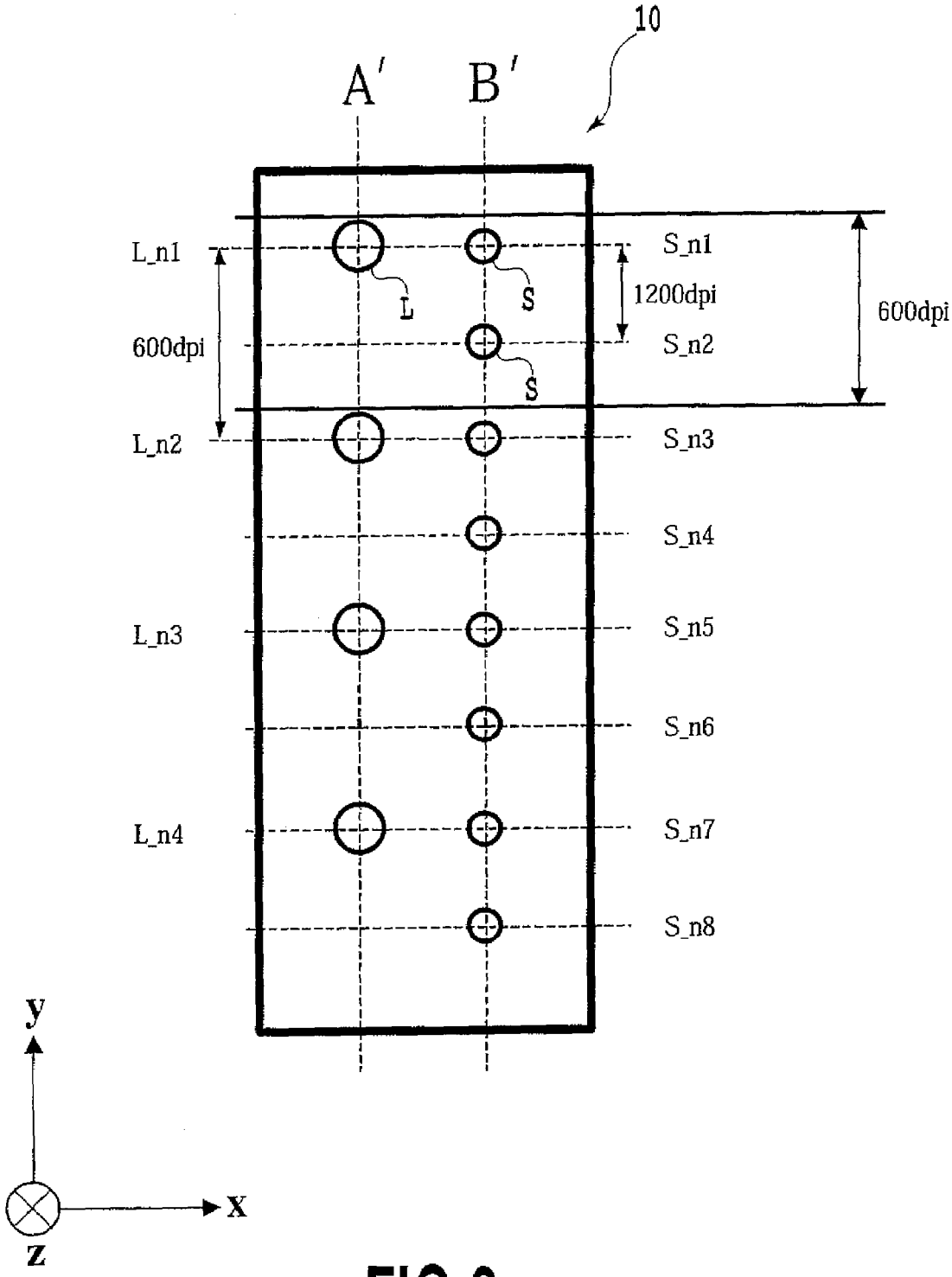
FIG. 3 is a schematic diagram showing a construction of a conventional print head.
Figure 4:
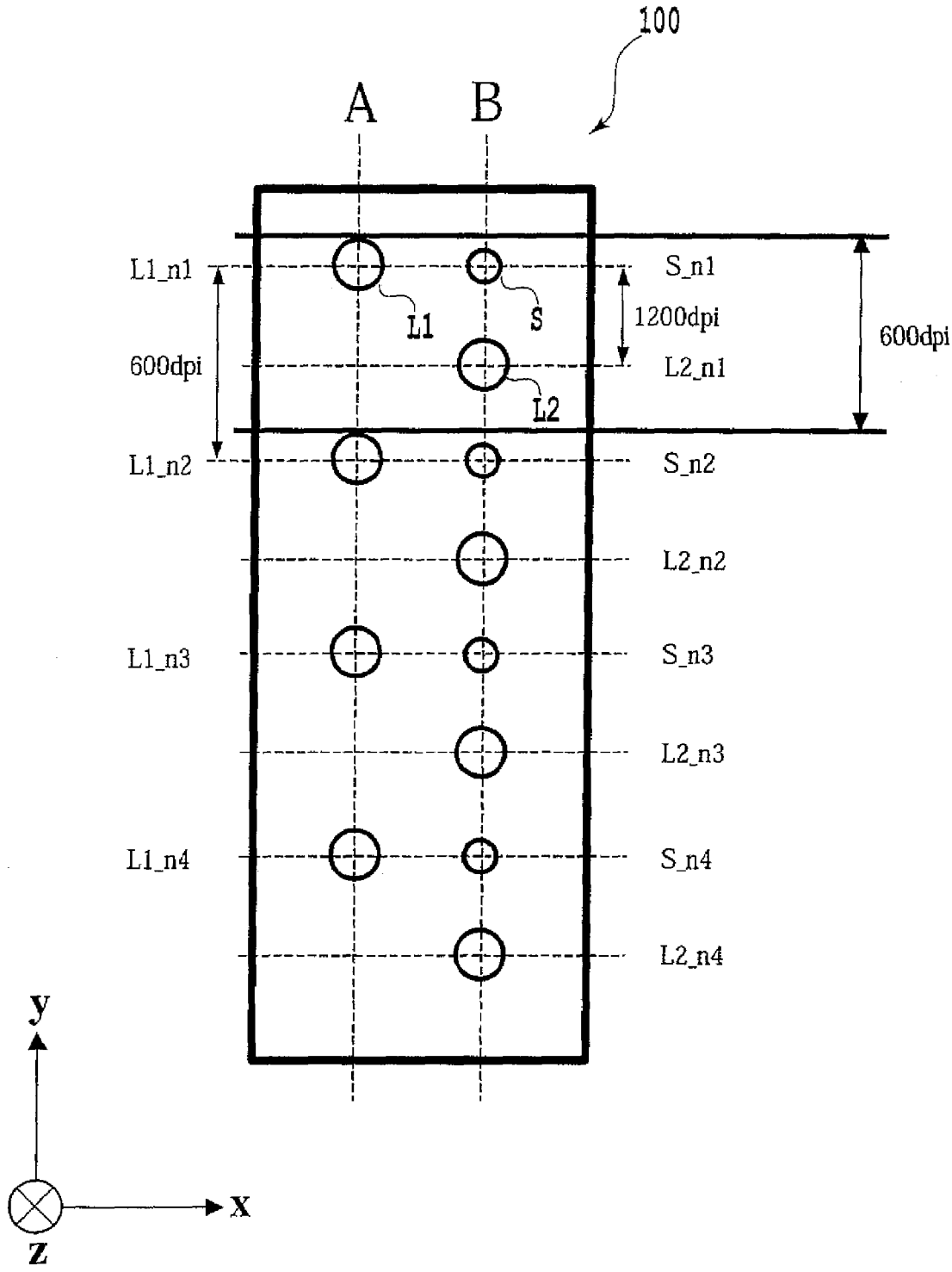
FIG. 4 is a schematic diagram showing a construction of a print head in a first embodiment of this invention.

FIG. 3 illustrates a conventional ink jet print head 10 and FIG. 4 illustrates an ink jet print head 100 in the first embodiment of this invention. The ink jet print heads 10, 100 shown in FIG. 3 and FIG. 4 are ones that both eject cyan inks.

The conventional ink jet print head 10 shown in FIG. 3 is formed with a orifice array A' (orifice group A') and a orifice array B' (orifice group B') each having ink orifices arrayed in the subscan direction (y direction) perpendicular to the main scan direction (x direction). The orifice array A' has n orifices arrayed at equal intervals at 600 dpi (600 orifices per inch). The orifice array B' has 2n ink orifices at equal intervals at 1200 dpi (1200 orifices per inch). In the figure, the orifice array A' is shown to have only four (n) and the orifice array B' only eight (2n) for convenience.

The orifice array A' of FIG. 3 is comprised of only large-diameter orifices (large orifices) L that eject ink droplets of 10 pl (pico-liters). Ll_n1 to L_N4 represent individual large orifices L. The orifice array B' is comprised of only small-diameter orifices (small orifices) S that eject ink droplets of 2 pl. S_n1 to S_n8 represent individual small orifices S.

The orifices of the orifice array A' and the orifices of the orifice array B' have the following positional relation in the subscan direction (y direction). That is, odd-numbered ink orifices of the orifice array B' (S_n1, S_n3, S_n5, S_n7) are arranged at the same positions in the subscan direction as the orifices of the orifice array A' (L_n1, L_n2, L_n3, L_n4). Even-numbered orifices of the orifice array B' (S_n2, S_n4, S_n6, S_n8) are arranged at positions shifted 1200 dpi in the subscan direction from those of the ink orifices (L_n1, L_n2, L_n3, L_n4).

As for the number of orifices, the conventional ink jet print head 10 therefore has one large orifice and two small orifices in each length of 600 dpi in the subscan direction.

The ink jet print head 100 of the first embodiment of this invention shown in FIG. 4 has ink orifices arranged as follows. That is, the print head 100 is formed with an orifice array A and an orifice array B each having orifices arrayed at equal intervals in the subscan direction (y direction). The orifice array A has n ink orifices arrayed at equal intervals at 600 dpi (600 orifices per inch) in the subscan direction. The orifice array B has 2 n ink orifices arrayed at equal intervals at 1200 dpi (1200 orifices per inch) in the subscan direction. In the figure, the orifice array A is shown to have only four (n) and the orifice array B only eight (2n) for convenience.

The orifice array A of FIG. 4 is comprised of only large-diameter orifices (large ink orifices) L that eject ink droplets of 10 pl. L1_n1 to L1_n4 represent individual large orifices L. The orifice array B is comprised of small-diameter orifices (small ink orifices) S that eject ink droplets of 2 pl and large-diameter orifices (large ink orifices) L that eject ink droplets of 10 pl. Here, S_n1 to S_n4 represent individual small orifices and L2_n1 to L2_n4 individual large orifices. As shown in the figure, the orifice array B has the small orifices S and the large orifices L alternately arranged at 1200 dpi in the subscan direction.

The large orifices L of the orifice array A and the orifices S and L of the orifice array B have the following positional relation in the subscan direction. That is, the small orifices S of the orifice array B (S_n1, S_n2, S_n3, S_n4) are located at the same positions in the subscan direction as the large orifices L of the orifice array A (L1_n1, L1_n2, L1_n3, L1_n4). The large orifices L of the orifice array B (L2_n1, L2_n2, L2_n3, L2_n4) are arranged at positions shifted 1200 dpi in the subscan direction from those of the large orifices L of the orifice array A.

The ink jet print head 100 of the first embodiment therefore has in the length of 600 dpi in the subscan direction two large orifices L and one small orifice S. That is, the number of orifices in the unit length making up the large orifice group which is comprised of the large orifices of orifice array A and orifice array B is greater than that of ink orifices in the unit length making up the small orifice group which is comprised of the small orifices of orifice array B.

The ink jet print heads 10, 100 shown in FIG. 3 and FIG. 4 is driven at a drive frequency of 15 kHz to eject ink droplets from the orifices. These print heads also have a scan speed in the main scan direction of 25 inches/sec at which they travel in the main scan direction while ejecting ink droplets at intervals of 600 dpi.

Figure 5:
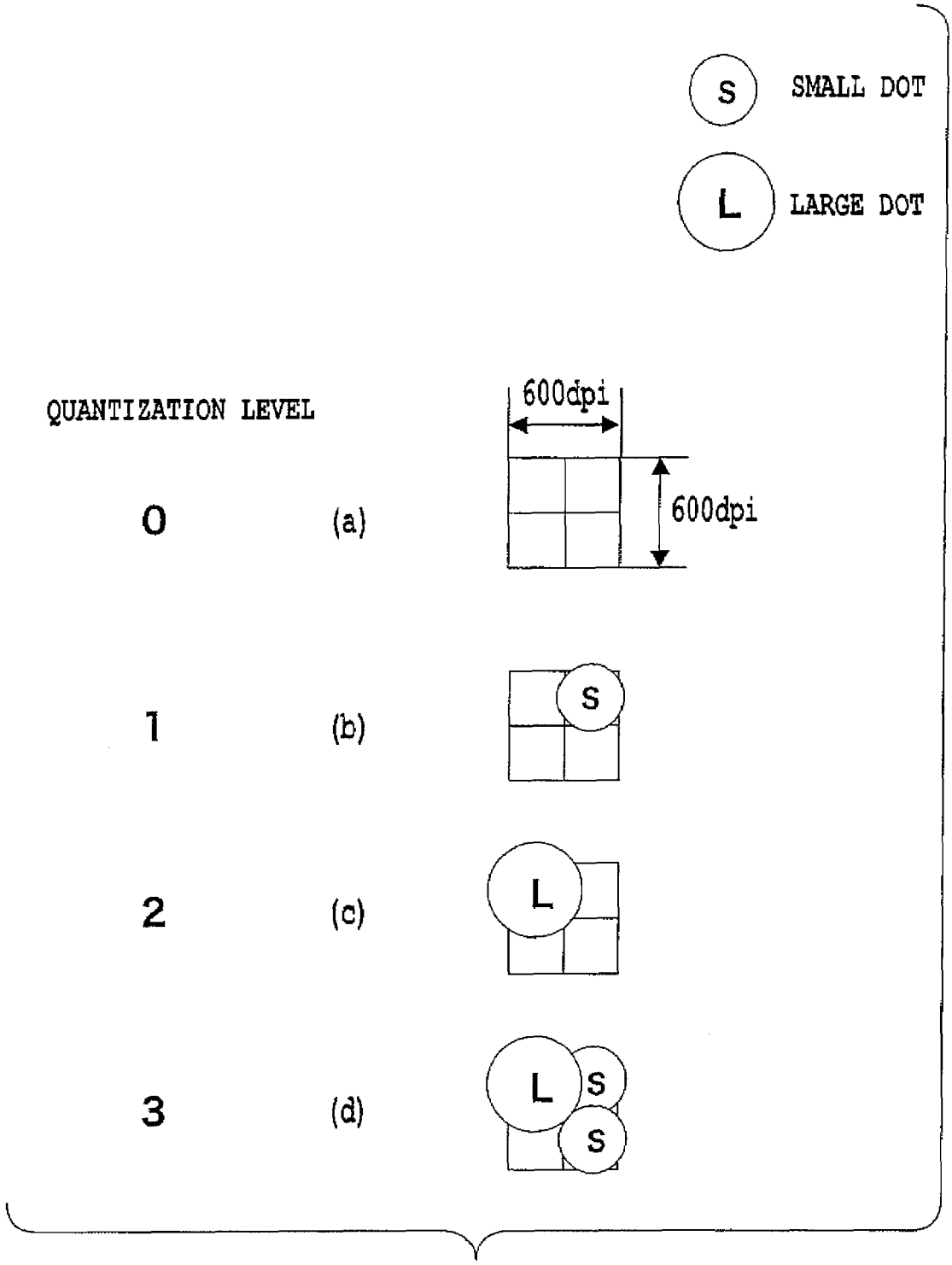
FIG. 5 shows a relation between a quantization level (0-3) of image data for each pixel and a corresponding dot pattern ((a)-(d)) formed in that pixel on a print medium when a 1-pass printing is executed using the conventional print head.

FIG. 5 shows a relation between a quantization level of image data for each pixel and a dot pattern formed in that pixel on the print medium when a so-called 1-pass printing, which completes an image in a particular scan area in one scan by the conventional print head 10 of FIG. 3, is performed.

As shown in FIG. 5, the density of each pixel with a resolution of 600×600 dpi is represented by one of four gradation levels specified by the quantization levels 0-3. More specifically, each pixel forming area is divided into a matrix of 2×2 segments, on which two kinds of ink droplets of different volumes are ejected to land, forming one of dot patterns (b)-(d) made up of different sizes of dots. A total of four dot patterns, including a no-dot pattern (see FIG. 5(*a*)) with no dots formed in the pixel forming area, represents four gradation levels specified by the quantization levels 0-3. In FIG. 5, dots of different sizes are assigned symbols L, S of orifices from which they are ejected.

A quantization level 0, as shown in FIG. 5(*a*), corresponds to a no-dot pattern that has no dots formed in the pixel forming area. A quantization level 1 corresponds to a pattern (FIG. 5(*b*)) in which one small dot S of a 2-pl ink droplet is formed in one of four segments of the pixel forming area. A quantization level 2 corresponds to a pattern (FIG. 5(*c*)) in which one large dot L of 10-pl ink droplet is formed in one of four segments of the pixel forming area. A quantization level 3 corresponds to a pattern (FIG. 5(*d*)) in which a combination of two small dots of 2-pl ink droplets and one large dot L of 10-pl ink droplet is formed. The ink volume applied to the 600×600-dpi pixel forming area for each gradation level is 0 pl at quantization level 0, 2 pl at quantization level 1, 10 pl at quantization level 2 and 14 pl at quantization level 3. In one main scan, since the number of dots that can be formed in each 600×600-dpi pixel forming area by each orifice is one dot, the maximum ink volume applicable to each pixel forming area is 14 pl corresponding to the quantization level 3.

Figure 6:
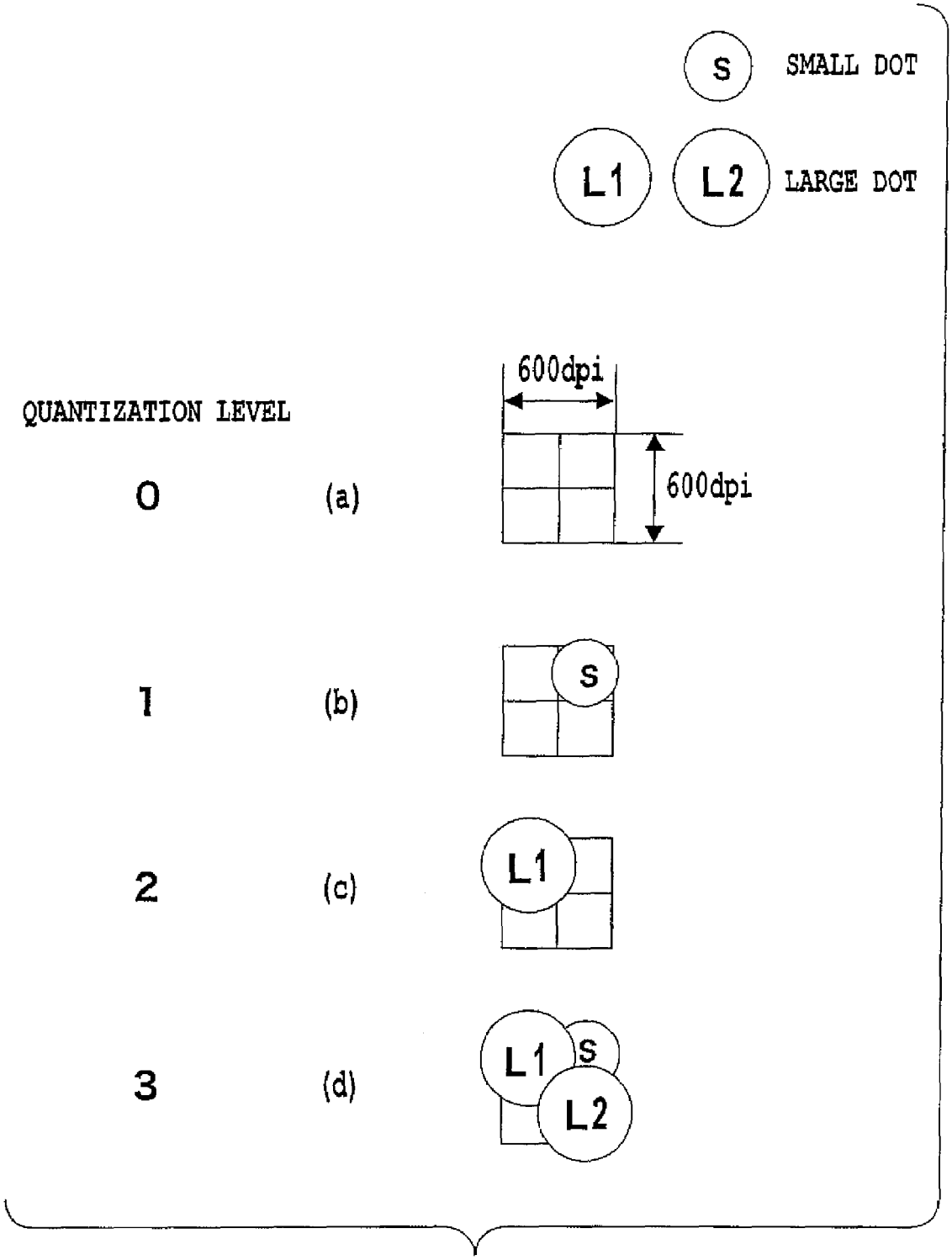
FIG. 6 shows a relation between a quantization level (0-3) of image data for each pixel and a corresponding dot pattern ((a)-(d)) formed in that pixel on a print medium when a 1-pass printing is executed using the print head of the first embodiment of this invention.

FIG. 6 shows a relation between a quantization level of image data for each pixel and a dot pattern formed in that pixel on the print medium when a 1-pass printing is performed using the ink jet print head 100 of the first embodiment of FIG. 4.

In this embodiment too, each pixel forming area with a resolution of 600×600 dpi is divided into 2×2 segments, to which two kinds of dots of different sizes are applied, forming one of dot patterns of FIG. 6(*b*)-(*d*). A total of four dot patterns, including a no-dot pattern (see FIG. 6(*a*)) with no dots formed in the pixel forming area, represent four gradation levels specified by the quantization levels 0-3. In FIG. 6, dots of different sizes are assigned symbols L1, L2, S of the orifices from which they are ejected.

A quantization level 0 corresponds to a no-dot pattern, as shown in FIG. 6(*a*). A quantization level 1 corresponds to a pattern (FIG. 6(*b*)) in which one small dot S of a 2-pl ink droplet is formed in one of four segments of the pixel forming area. A quantization level 2 corresponds to a pattern (FIG. 6(*c*)) in which one large dot L1 of 10-pl ink droplet is formed in one of four segments of the pixel forming area. A quantization level 3 corresponds to a pattern (FIG. 6(*d*)) in which a combination of one small dot of 2-pl ink droplet and two large dots L1, L2 of 10-pl ink droplets is formed.

As described above, in the first embodiment, the ink volume applied to the 600×600-dpi pixel forming area is 0 pl at quantization level 0, 2 pl at quantization level 1, 10 pl at quantization level 2 and 22 pl at quantization level 3. In one main scan, since the number of dots that can be formed in each 600×600-dpi pixel forming area by each orifice is one dot, the maximum ink volume applicable to each pixel forming area is 22 pl corresponding to the quantization level 3.

The gradation level (0-3) is determined by a printer driver processing input multilevel image data, the printer driver being installed in the ink jet printing apparatus or in a host computer connected to the printing apparatus. For example, the 256-level image data entered into the host computer undergoes half-toning processing by the printer driver whereby it is converted into 2-bit index data representing a 4-level gradation and output to the ink jet printing apparatus. Based on this index data, the ink jet printing apparatus performs dot patterning processing to set a dot pattern described above and drives the print head 10 or 100 to form the dot pattern thus set. In the first embodiment, the above half-toning processing and the index processing are executed in a way similar to that of the conventional ink jet printing apparatus using the print head 10.

Figure 7:
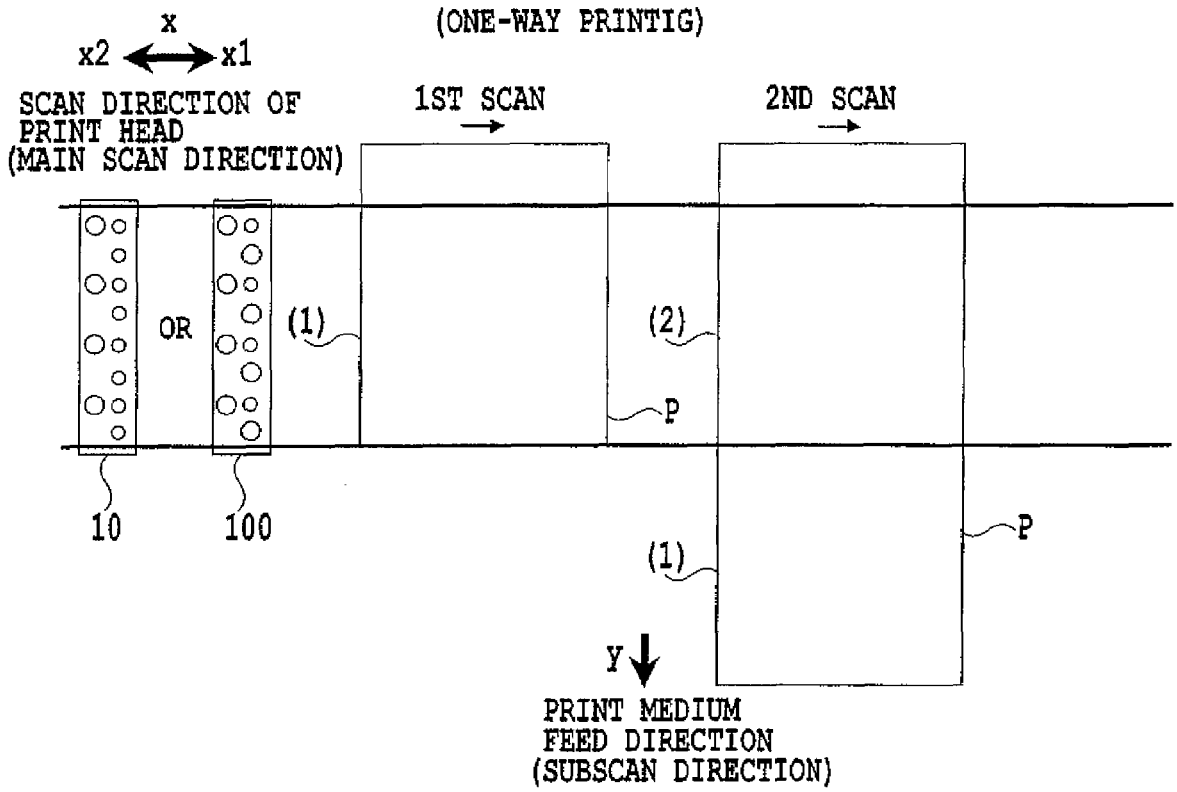
FIG. 7 is a diagram showing how a 1 pass printing is performed using a conventional print head 10 of FIG. 3 or print head of the first embodiment.

FIG. 7 illustrates a 1-pass printing performed by the conventional print head 10 of FIG. 3 or the print head 100 of the first embodiment of FIG. 4.

In FIG. 7, in the first scan, the print head 10 or 100 is moved from the predetermined print start position in the forward direction (x1 direction) and ejects ink from all orifices as it scans over an image area (1) on the print medium P, thereby completing an image in the image area (1). Then, the print medium P is fed 4/600 inches (8/1200 inches) in the subscan direction, which corresponds to an overall orifice arrangement width (orifice array length in the subscan direction) of the print head 10 or 100. After the first scan is finished, the print head 10 or 100 returns to a reference position, such as home position h, for another printing scan. In the second and subsequent scan, the print head 10 or 100 is driven in the same direction as in the first scan to perform printing. The printing operation that performs printing by driving the print head 10 or 100 in a fixed direction (forward direction) at all times is called a one-way printing.

FIG. 8 shows a relation between an ink volume applied to a 600×600-dpi pixel forming area according to the associated quantization level (1-3) and an image density (optical density), for both the conventional print head 10 and the print head 100 of the first embodiment.

FIG. 8 shows that if the ink volume applied to the 600×600-dpi image forming area exceeds 22 pl, the image density does not go higher than that produced when 22 pl of ink is applied. This means that the image density saturates when the ink volume applied reaches 22 pl. For the quantization level of 0, 1 and 2, the same volumes of ink are applied to the image forming area by both the conventional print head and the print head of this embodiment. So, the resulting image densities for each quantization level are the same. For the quantization level of 3, however, the print head 100 of this embodiment enhances the image density to about 0.55 by the 1-pass printing, whereas the conventional print head 10 can only increase the image density to about 0.40 by the 1-pass printing.

Therefore, the 1-pass printing by the conventional print head 10 results in a faded printed image with low density. To print an image with high density using the conventional print head 10 requires increasing the number of printing scans performed to complete an image or slowing down the print head scan speed to eject a plurality of ink droplets from the same orifice onto the same image forming area.

Figure 9:
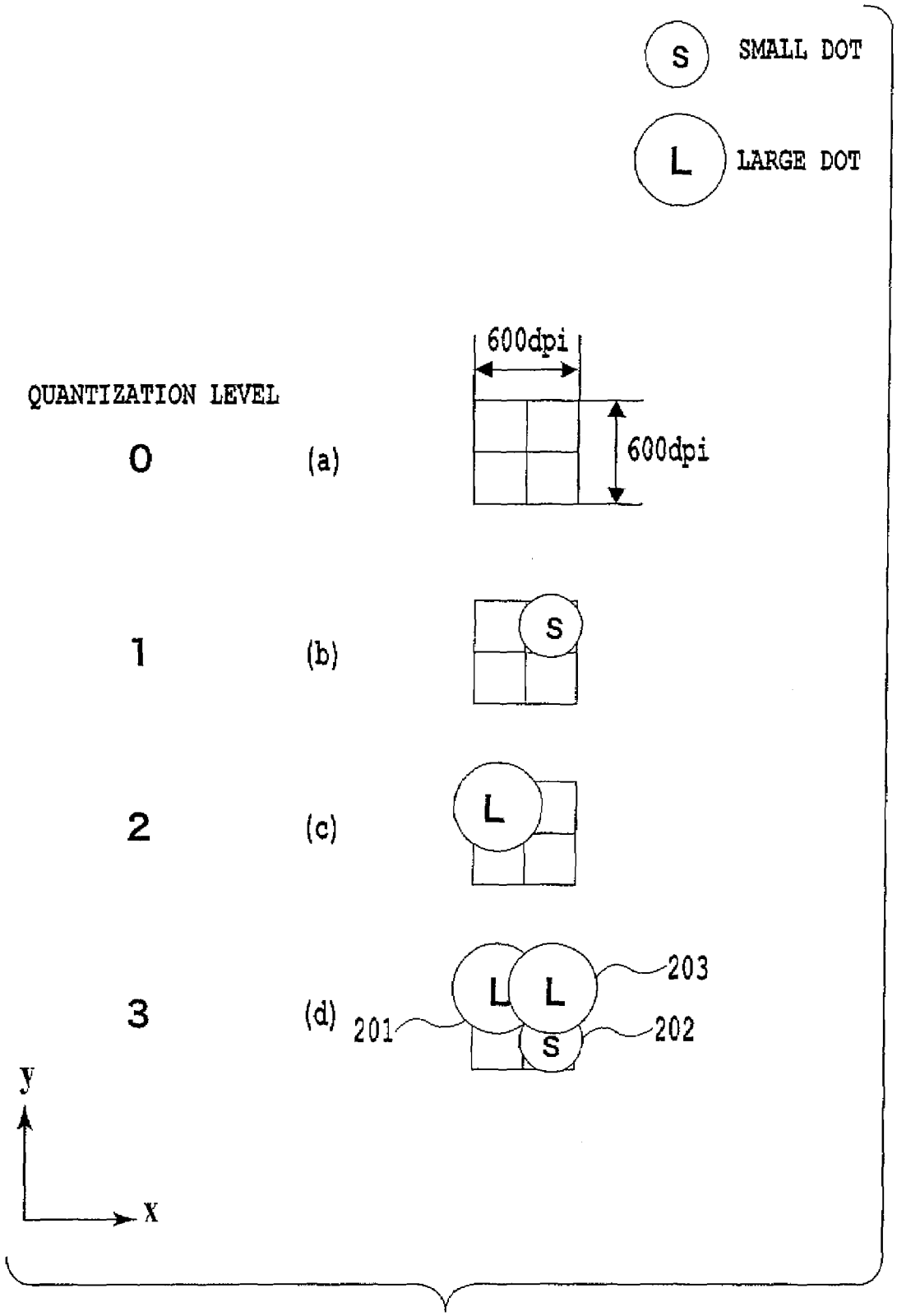
FIG. 9 shows a relation between a quantization level (0-3) of image data and the corresponding dot pattern ((a)-(d)) when the pixel forming area is applied ink using the conventional print head of FIG. 3 until the image density is saturated.

FIG. 9 shows a relation between a quantization level of image data and a dot pattern when the conventional print head 10 is used to apply ink to a 600×600-dpi image forming area until the image density saturates, i.e., when 22 pl of ink is applied.

For the quantization level of 0-2, the dot patterns are the same as shown in FIG. 5. For the quantization level of 3, a dot pattern shown in FIG. 9(*d*) is formed which is comprised of a combination of one small dot of 2 pl and two large dots of 10 pl.

To print the dot pattern of FIG. 9(*d*) by ejecting ink droplets from each orifice at intervals of 600 dpi in the main scan direction while moving the print head 10 in the main scan direction (x direction) at 25 inches/sec, the main scan needs to be performed twice. That is, a large dot 201 and a small dot 202 shown in FIG. 9(*d*) are printed in the first main scan, followed by a large dot 203 in the second main scan (first printing method).

A second method of printing two large dots of 10 pl in a 600×600-dpi pixel forming area by the 1-pass printing involves reducing the print head moving speed in the main scan direction to 12.5 inches/sec, one-half the speed of 25 inches/sec. By ejecting ink droplets at 1200-dpi intervals, the large dots 201, 203 shown in FIG. 9(*d*) are formed in series and the small dot 202 is printed at a timing that makes its printed position in the main scan direction equal to that of the large dot 203. In FIG. 9, dots of different sizes are assigned symbols L, S of the orifices from which they are ejected.

As described above, when the conventional ink jet print head 10 is used to realize a high-density printing, it is necessary to adopt the first or second printing method, either of which will result in an increase in the printing time.

On the other hand, the first embodiment allows for a high-density printing as shown FIG. 6(*d*) at high speed without having to increase the number of scans or lower the scan speed in a printing operation that realizes gradation representation by using a combination of two kinds of ink droplets of different volumes. Further, image processing or processing inside the ink jet printing apparatus can also be executed in the same way as with the conventional printing apparatus.

Since the print head 100 of this embodiment has the same number of orifices as that of the conventional print head 10, there is no increase in the size of the semiconductor board that integrates the ejection energy generation elements. This in turn prevents an increase in cost and size of the printing apparatus as a whole.

Second Embodiment

Next, a second embodiment of this invention will be explained.

In the first embodiment, the print head 100 has been shown to have two orifice arrays. This invention is not limited to a particular number of orifice arrays and three or more orifice arrays may be provided. The second embodiment has three orifice arrays.

Figure 10:
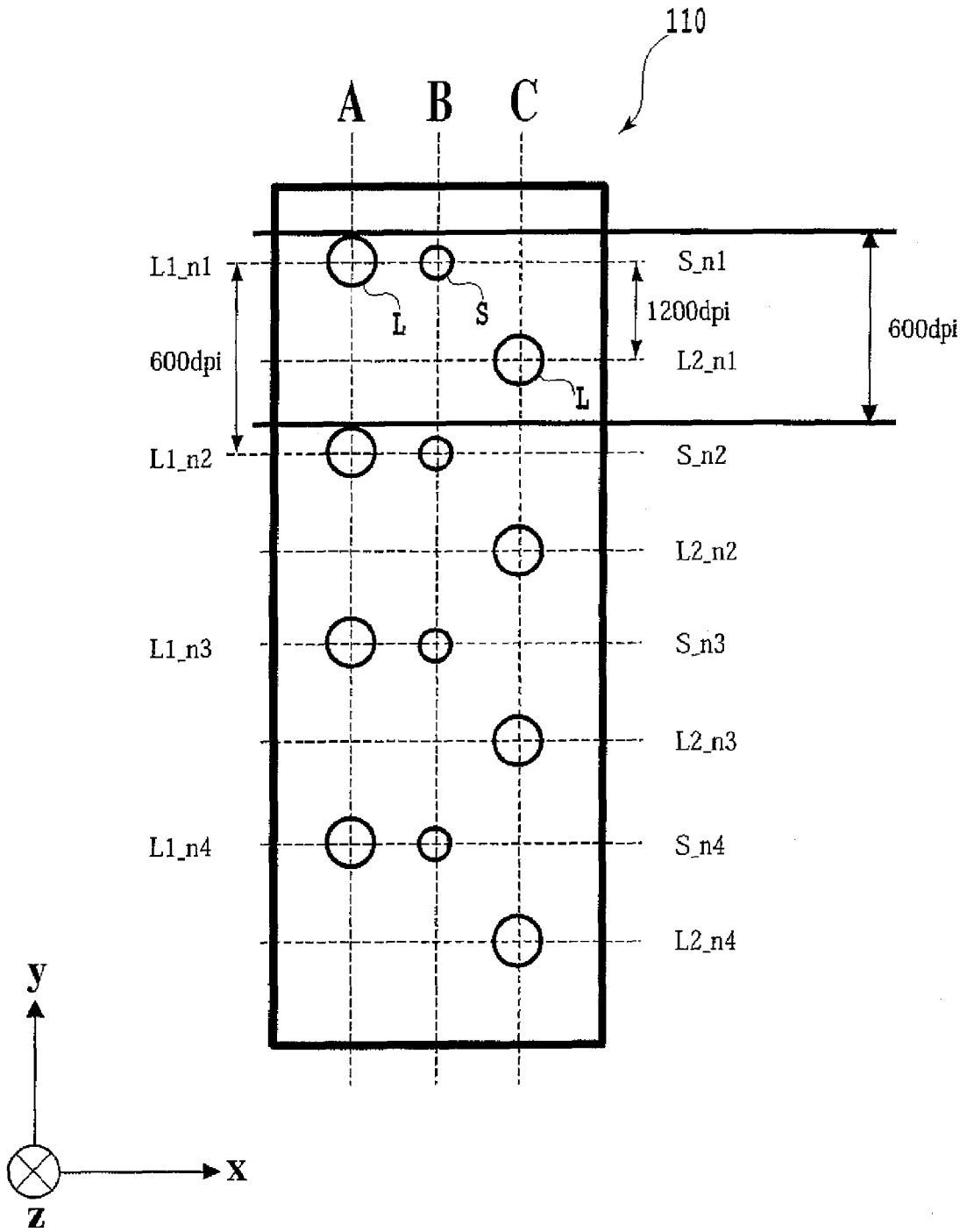
FIG. 10 is a schematic diagram showing a construction of a print head in a second embodiment of this invention.
Figure 11:
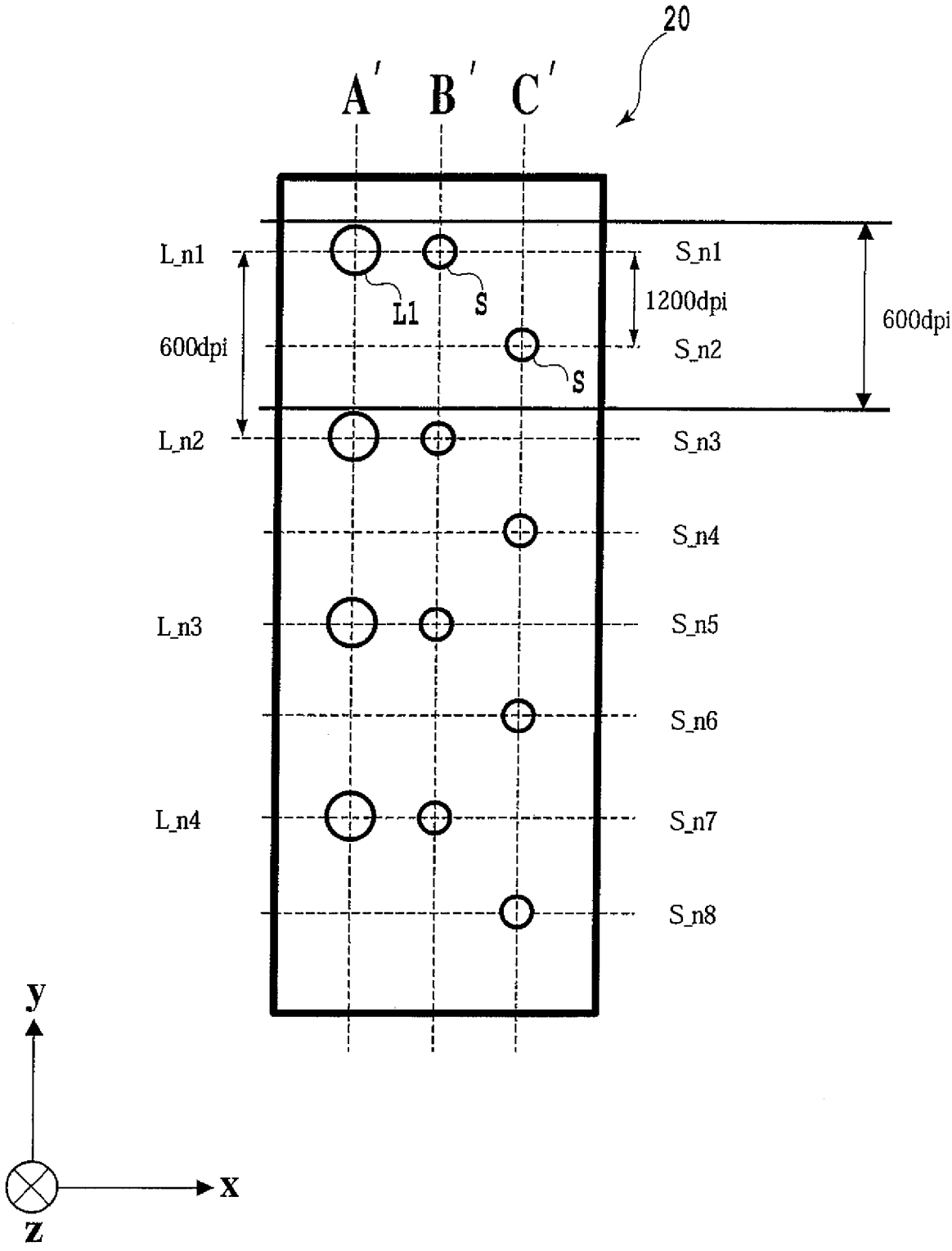
FIG. 11 is a schematic diagram showing a construction of a print head for comparison with the print head of FIG. 10.

FIG. 10 shows a print head 110 of the second embodiment and FIG. 11 shows a conventional print head 20 for comparison with the second embodiment. As shown in FIG. 10 and FIG. 11, the print heads 110, 20 each have three orifice arrays A, B, C, A', B', C' extending in the subscan direction (y direction). The ink orifices making up each of the orifice arrays A, B, C, A', B', C' are arranged at intervals of 600 dpi in the subscan direction.

The orifice arrays A and C in the print head 110 of the second embodiment are each comprised of a plurality of large orifices L with a relatively large diameter that eject large ink droplets of 10 pl. These large orifices L constitute a large orifice group. The large orifice group in this case includes the orifice array A and the orifice array C. The orifice array B is comprised of a plurality of small orifices S with a relatively small diameter. A small orifice group in this case includes only the orifice array B. In FIG. 10, L1_n1, L1_n2, L1_n3, L1_n4 represent individual large ink orifices L in the orifice array A. S_n1, S_n2, S_n3, S_n4 represent individual small orifices S in the orifice array B. L2_n1, L2_n2, L2_n3, L2_n4 represent individual large ink orifices L in the orifice array C. The large orifices L1_n1, L1_n2, L1_n3, L1_n4 in the orifice array A and the small orifices S_n1, S_n2, S_n3, S_n4 in the orifice array B are located at the same positions in the subscan direction. The large orifices L1_n1, L1_n2, L1_n3, L1_n4 in the orifice array A and the large orifices L2_n1, L2_n2, L2_n3, L2_n4 in the orifice array C are located at positions shifted 1200 dpi in the subscan direction.

In the ink jet print head constructed as described above, the number of large orifices L is greater than that of small orifices S in a unit length (600 dpi) corresponding to the length in the subscan direction of the pixel forming area. That is, there are two large orifices L and one small orifices S in the unit length. In other words, the number of ink orifices in the unit length constituting the large orifice group is greater than the number of ink orifices in the unit length constituting the small orifice group.

In this arrangement, when a 1-pass printing is performed at a scan speed of 25 inches/sec and a drive frequency of 15 kHz, the 600×600-dpi pixel forming area can be applied up to 22 pl of ink, as in the case of the first embodiment. Therefore, a high-density image can be printed at high speed.

In the conventional print head 20 of FIG. 11, only the orifice array A' of the three orifice arrays A', B', C' is comprised of large orifices L, with the remaining orifice arrays B', C' both comprised of small orifices S. Therefore, when a 1-pass printing is performed at the same scan speed and drive frequency as described above, the 600×600-dpi pixel forming area can only be applied up to 14 pl of ink, as in the conventional print head 10 of FIG. 3, resulting in low-density images. So, to print a high-density image requires performing the scan two or more times or lowering the scan speed, which in turn reduces the print speed significantly. With the second embodiment, however, substantial improvements are gained in terms of gradation of image from the conventional print head 20. Further, since the print head of the second embodiment has the same number of orifices as that of the conventional print head 20, there will no be no increase in the manufacturing cost and the print head size.

Third Embodiment

Next, a third embodiment of this invention will be explained.

The preceding embodiments have been described to have a plurality of orifice arrays in the print head. A print head in the third embodiment has two kinds of orifices arrayed in an array, the two kinds of orifices being adapted to eject ink droplets of different volumes.

FIG. 12 shows a construction of a print head 120 of the third embodiment. In FIG. 12, the print head 120 has arrayed in an array in the subscan direction large orifices L for ejecting ink droplets of 10 pl and small orifices S for ejecting ink droplets of 2 pl. Intervals between the centers of the adjoining orifices are set equal, in this example, at 1800 dpi. In this orifice array, two large orifices L and one small orifice S are arranged in each unit length (length of the pixel forming area: 600 dpi) in the subscan direction (y direction). In FIG. 12, L_n1 to L_n8 denote individual large orifices L and S_n1 to S_n4 denote individual small orifices S.

When a 1-pass printing is performed at a scan speed of 25 inches/sec and a drive frequency of 15 kHz, the 600×600-dpi pixel forming area can be applied up to 22 pl of ink, as in the first embodiment. Thus, a high-density image can be formed at high speed.

Figure 13:
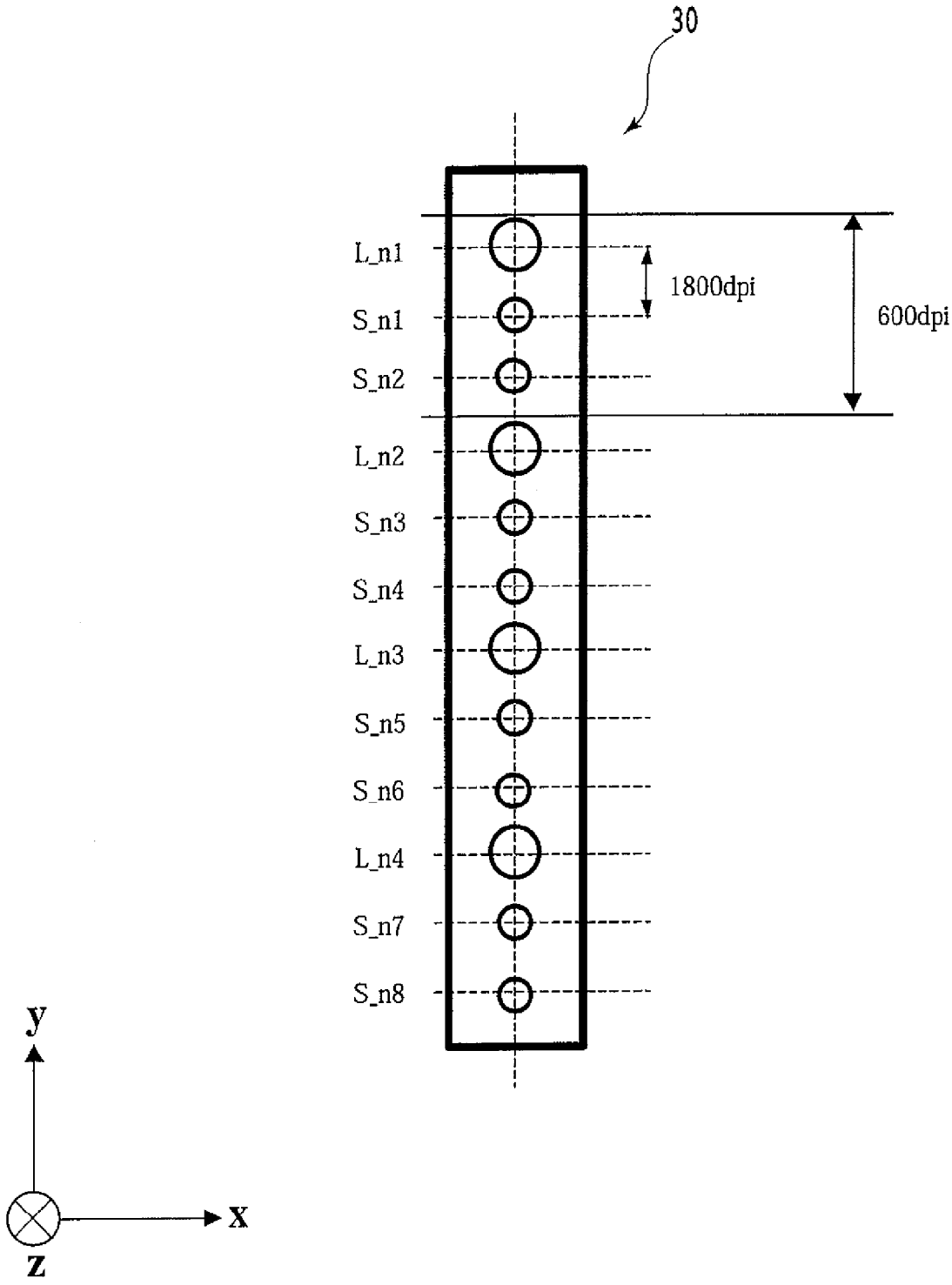
FIG. 13 is a schematic diagram showing a construction of a conventional print head for comparison with the print head of FIG. 12.

On the other hand, with the conventional print head 30 of FIG. 13, in which one large orifice L and two small orifices S are arranged in every unit length (600 dpi) in the subscan direction, a 1-pass printing similar to the one described above cannot produce a sufficient density in the printed image. That is, the 600×600-dpi pixel forming area can only be applied up to 14 pl of ink, forming images with a low maximum density.

To print a high-density image, the scan needs to be performed multiple times, substantially reducing the print speed.

The third embodiment, as described above, is significantly improved over the conventional print head 30 in terms of gradation of image and print speed. Since the number of orifices is the same as that of the conventional print head 30, the manufacturing cost and size of the print head of the third embodiment will not be greater than those of the conventional print head 30.

Fourth Embodiment

In the above embodiments, the print heads with two kinds of orifices, which are large orifices L for ejecting large ink droplets and small orifices S for ejecting small ink droplets have been described. It is noted, however, that this invention is not limited to the above embodiments and may be applied to print heads with three or more kinds of orifices that eject three kinds of ink droplets of different volumes. A print head of a fourth embodiment of this invention having three kinds of orifices will be explained as follows.

Figure 14:
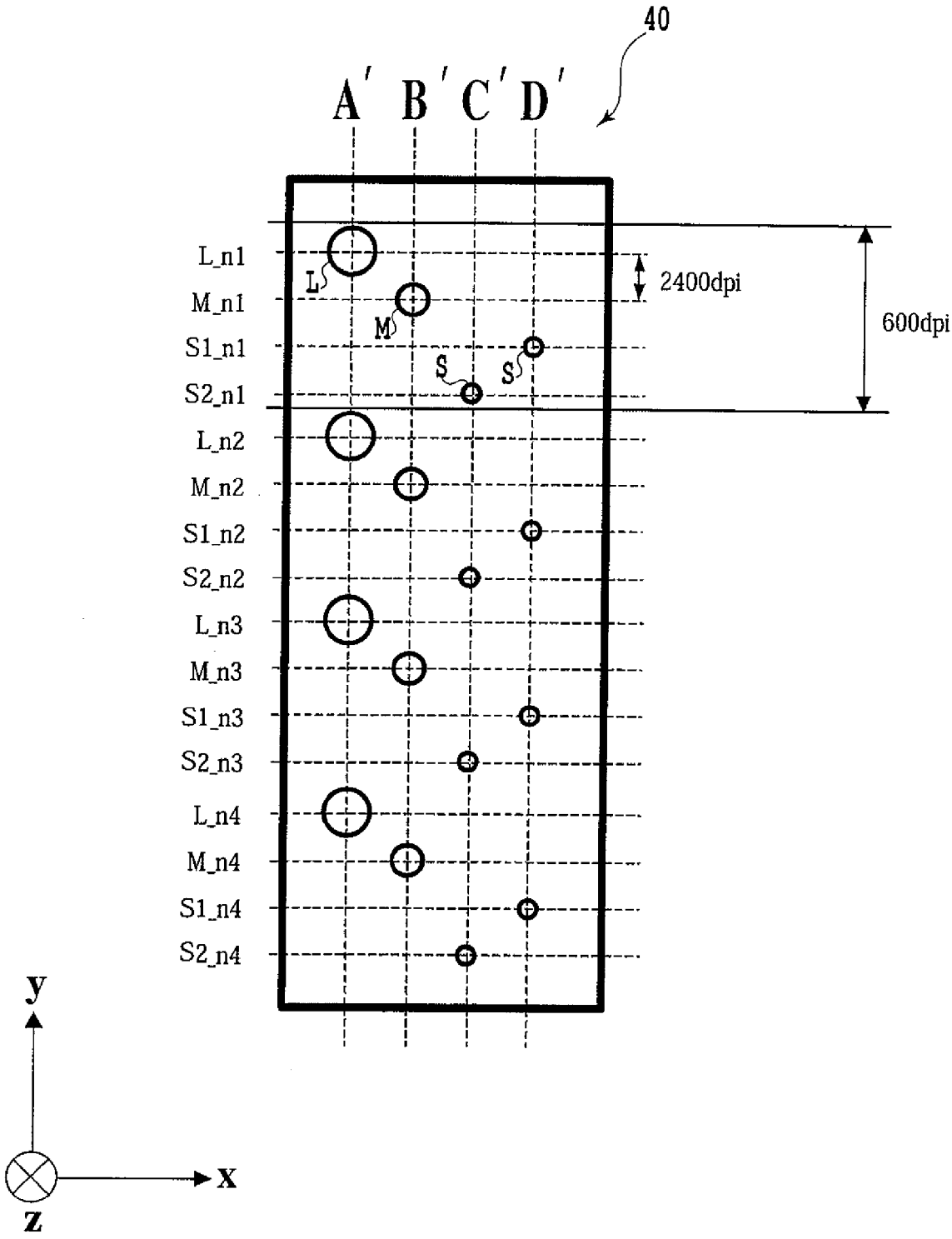
FIG. 14 is a schematic diagram showing a construction of a print head for comparison with a print head of FIG. 15.
Figure 15:
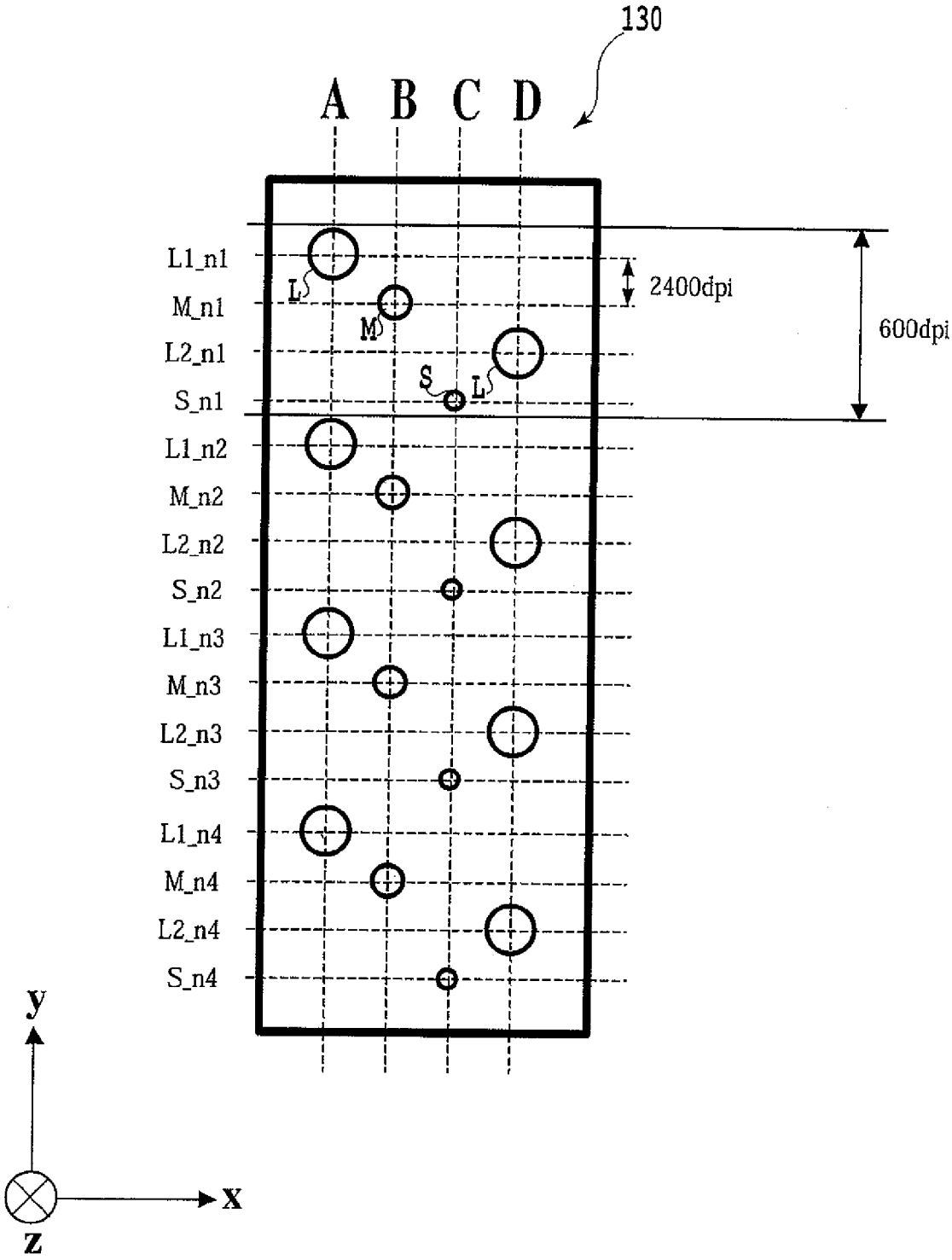
FIG. 15 is a schematic diagram showing a construction of a print head in a fourth embodiment of this invention.

FIG. 14 illustrates a virtual ink jet print head shown for comparison with the print head of the fourth embodiment. FIG. 15 illustrates an ink jet print head of the fourth embodiment of the invention. The ink jet print head of FIG. 14 and FIG. 15 both ejects a cyan ink.

An ink jet print head 40 shown in FIG. 14 and an ink jet print head 130 of this embodiment shown in FIG. 15 both have four orifice arrays extending in the subscan direction (y direction) and arranged in the main scan direction. Each orifice array has n ink orifices arrayed at a density of 600 per inch (600 dpi). In the figure, only four orifices are shown as the orifices (n) making up each orifice array for the sake of convenience.

The print head 40 of FIG. 14 is provided with four orifice arrays A', B', C', D'. The orifice array A' has only large-diameter orifices (large orifices) L for ejecting 10-pl ink droplets and Ll_n1 to L_n4 represent individual large orifices L. The orifice array B' is composed of only medium-diameter orifices (medium orifices) M for ejecting 2-pl ink droplets and M_n1 to M_n4 represent individual medium orifices M. The orifice array C' is composed of only small-diameter orifices (small orifices) S for ejecting 0.5-pl ink droplets and S2_n1 to S2_n4 represent individual small orifices S. The orifice array D' is composed of only small-diameter orifices (small orifices) S for ejecting 0.5-pl ink droplets and S1_n1 to S1_n4 represent individual small orifices S.

The orifices of the orifice arrays B', C', D' are located at positions shifted in the subscan direction from the orifices of the orifice array A' (L_n1 to L_n4) by the following distances. The orifices of the array B' (M_n1 to M_n4) and the array D' (S1_n1 to S1_n4) are located at positions shifted 2400 dpi and 1200 dpi, respectively, in the subscan direction. The orifices of arrays C' (S2_n1 to S2_n4) are located at positions shifted 800 dpi in the subscan direction.

Therefore, in the unit length of 600 dpi in the subscan direction there are one large orifice L, one medium orifice M and two small orifices S.

On the other hand, the ink jet print head 130 of the fourth embodiment of this invention shown in FIG. 15 has four orifice arrays A, B, C, D. The orifice arrays A, D are comprised of only large-diameter orifices (large orifices) L adapted to eject 10-pl ink droplets. In FIG. 15, L1_n1 to L1_n4 denote orifices in the array A and L2_n1 to L2_n4 denote orifices in the array D. In FIG. 15, the large orifice group is made up of the orifice array A and the orifice array D.

The orifice array B is comprised of only medium-diameter orifices (medium orifices) M adapted to eject 2-pl ink droplets and denoted M_n1 to M_n4. The orifice array C is comprised of only small-diameter orifices (small orifices) S adapted to eject 0.5-pl ink droplets and denoted S_n1 to S_n4. In FIG. 15, the medium orifice group is made up of only the orifice array B and the small orifice group is made up of only the orifice group C.

The orifices of the orifice arrays B, C, D are located at positions shifted in the subscan direction from the orifices of the orifice array A (L1_n1 to L1_n4) by the following distances. That is, the orifices of the array B (M_n1 to M_n4) and the array C (S_n1 to S_n4) are located at positions shifted 2400 dpi and 800 dpi, respectively, in the subscan direction. The orifices of the array D (L2_n1 to L2_n4) are located at positions shifted 1200 dpi in the subscan direction.

In a unit distance of 600 dpi in the subscan direction, there are two large orifices L adapted to eject 10-pl ink droplets, one medium orifice M and one small orifice S. In other words the number of orifices in the unit length that form the large orifice group is greater than that of orifices in the unit length that form the medium orifice group or the small orifice group.

The ink jet print heads 40, 130 shown in FIG. 14 and FIG. 15 are driven at the same drive frequency of 15 kHz as that of the first embodiment to eject ink droplets from the orifices. The print heads 40, 130 are moved in the main scan direction at the scan speed of 25 inches/sec to eject ink droplets at 600-dpi intervals in the main scan direction for printing.

Figure 16:
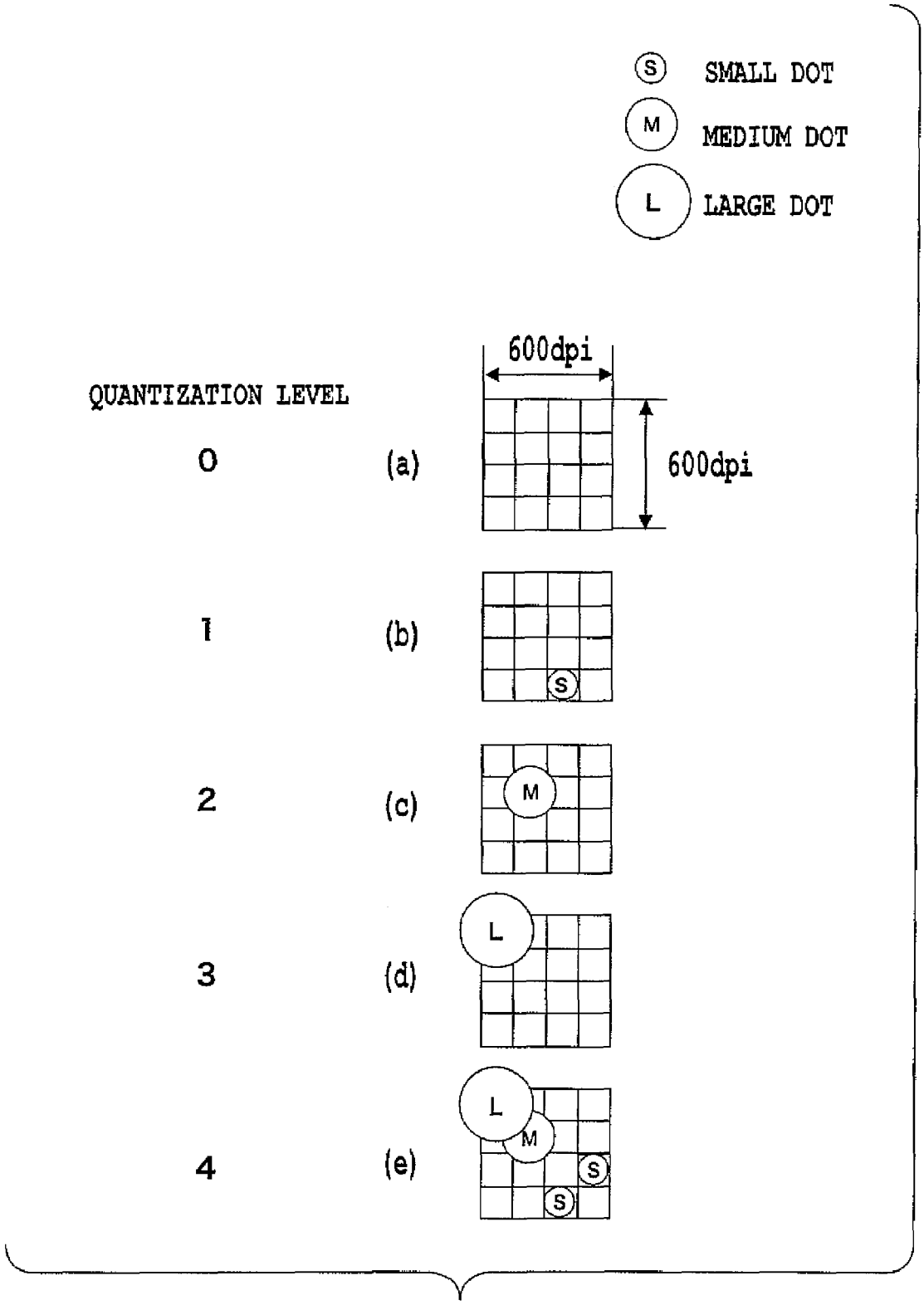
FIG. 16 shows a relation between a quantization level (0-4) of image data for each pixel and a corresponding dot pattern ((a)-(e)) formed in that pixel on a print medium when a 1-pass printing is executed using the print head of FIG. 14.

Next, we will describe a relation between a quantization level of image data for each pixel and a corresponding dot pattern formed in that pixel on a print medium when a 1-pass printing is executed by the conventional print head 40 and by the print head 130 of the fourth embodiment of this invention. FIG. 16 represents a case of the print head 40 and FIG. 17 represents a case of the print head 130 of this embodiment.

Figure 17:
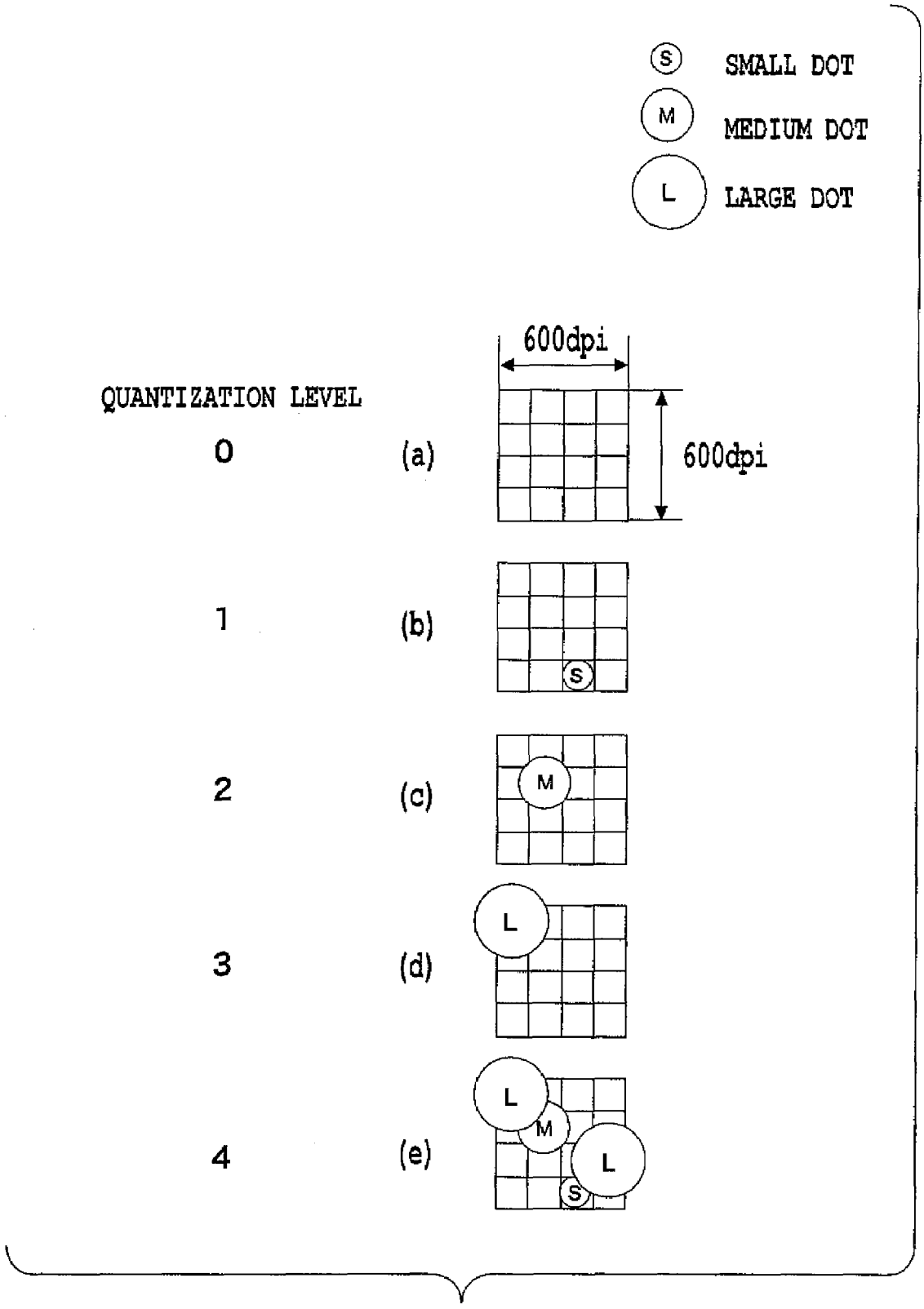
FIG. 17 shows a relation between a quantization level (0-4) of image data for each pixel and a corresponding dot pattern ((a)-(e)) formed in that pixel on a print medium when a 1-pass printing is executed using the print head of the fourth embodiment of this invention.

As shown in FIG. 16 and FIG. 17, the density of each pixel having a resolution of 600×600 dpi represents one of five gradation levels specified by the quantization levels 0-4. More specifically, each pixel forming area is divided into a matrix of 4×4 segments, on which three kinds of ink droplets of different volumes are ejected to land, forming one of dot patterns (b)-(e) made up of three different sizes of dots, which are large, medium and small. A total of five dot patterns, including a no-dot pattern shown in FIG. 16(*a*) and FIG. 17(*a*), represents five gradation levels specified by the quantization levels 0-4. In the figures, dots of different sizes are assigned symbols S, M, L of orifices from which they are ejected.

When the conventional print head 40 is used, the quantization level 0 corresponds to the no-dot pattern shown in FIG. 16(*a*). The quantization level 1 corresponds to a dot pattern (shown in FIG. 16(*b*)) in which one small dot S is formed in one segment. The quantization level 2 corresponds to a dot pattern (shown in FIG. 16(*c*)) in which one medium dot M is formed in one segment. The quantization level 3 corresponds to a dot pattern (shown in FIG. 16(*d*)) in which one large dot L is formed in one segment. The quantization level 4 corresponds to a combination dot pattern (shown in FIG. 16(*e*)) in which one large dot L, one medium dot M and two small dots S are formed. Therefore, when a 1-pass printing is performed by the print head 40, the ink volume applied to the 600×600-dpi pixel forming area is 0 pl for the quantization level 0, 0.5 pl for the quantization level 1, 2 pl for the quantization level 2, 10 pl for the quantization level 3, and 13.0 pl for the quantization level 4.

Where the print head 130 of the fourth embodiment of this invention is used, the quantization levels 0-3 correspond to dot patterns (see dot patterns shown in FIG. 17(*a*)-(*d*)) similar to those produced when the print head 40 is used. Their ink volumes applied are also equivalent to those when the print head 40 is used.

In the fourth embodiment, the quantization level 4 corresponds to a combination dot pattern of two large dots L, one medium dot M and one small dot S, as shown in FIG. 17(*e*). Therefore, the ink volume applied to the pixel forming area is 22.5 pl for the quantization level 4. Since the number of dots that each orifice can form in each pixel forming area during one main scan is one dot, the maximum ink volume applied for the quantization level 4 is 22.5 pl in this embodiment, as opposed to 13.0 pl in the conventional print head.

FIG. 18 shows a relation between the ink volume applied to the 600×600-dpi pixel forming area according to the quantization level (1-4) and a corresponding image density (optical density), for the print head 40 and for the print head 130 of this embodiment.

Figure 19:
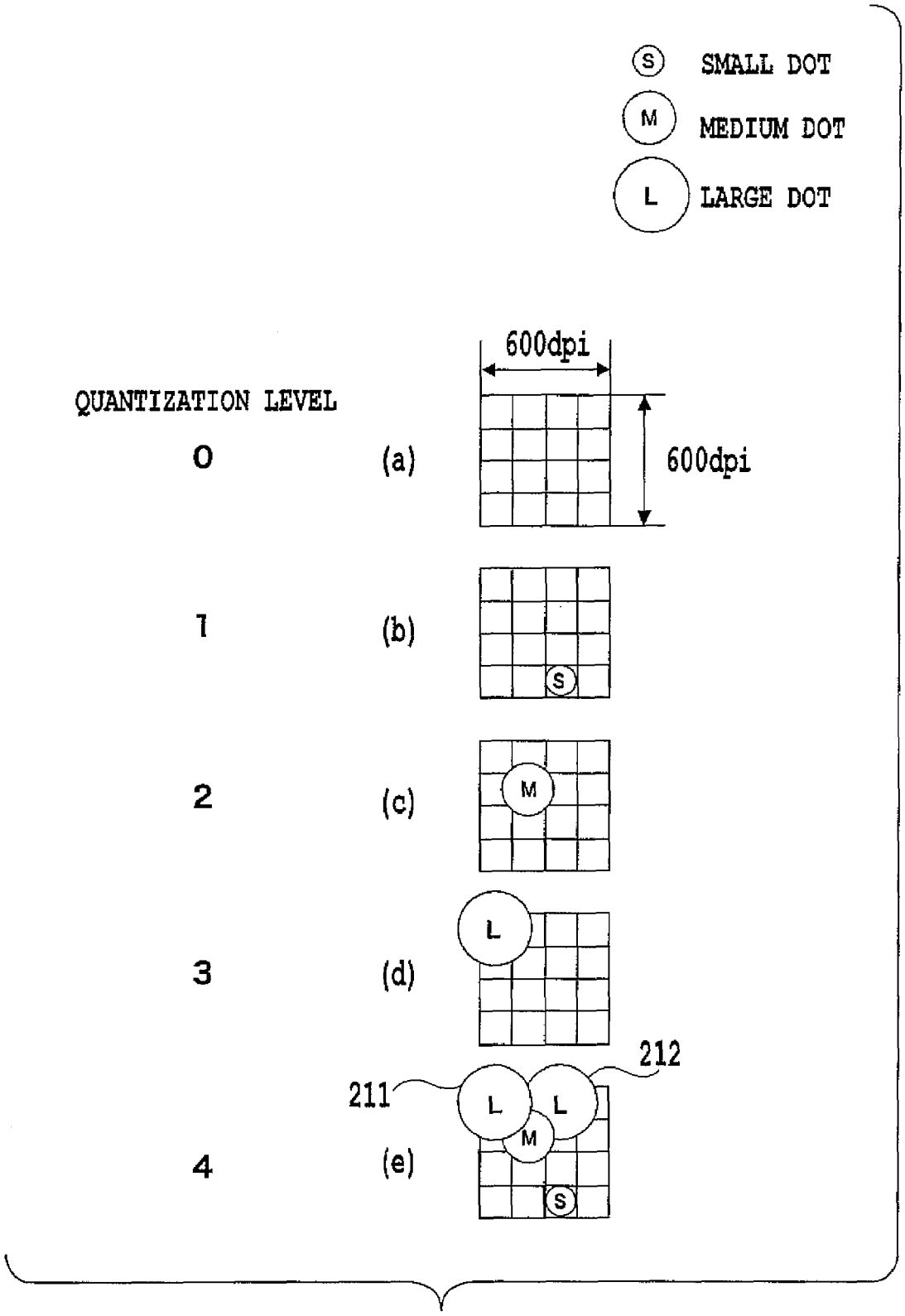
FIG. 19 shows a relation between a quantization level (0-4) of image data for each pixel and a corresponding dot pattern ((a)-(e)) formed in that pixel on a print medium when a low-speed printing or 2-pass printing is executed using the print head of FIG. 14.

For the quantization levels 1-3, the print head of this embodiment applies the same volume of ink to the pixel forming area (600×600 dpi) as does the print head of the comparison example, as shown in the figure. So, the image density produced is the same. For the quantization level 4, however, the print head 40 can produce a density of only about 0.40. So, to further increase the image density with the print head 40 requires performing a slow-speed printing or multiple printing scans. For example, the scan speed may be reduced to 12.5 inches/sec or two scans be performed in order to apply the same volume of ink to the 600×600-dpi pixel forming area as does the print head 130, as shown in the dot pattern of FIG. 19(*e*). This, however, results in a reduction in the printing speed. Further, since the dot pattern of FIG. 19(*e*) has its two adjoining dots formed at the same position in the subscan direction by one and the same large orifice L, a large blank region is created in the pixel forming area. This blank region will cause density variations appearing as lines.

With the print head 130 of this embodiment, on the other hand, the image density produced by the 1-pass printing can be increased to about 0.55, assuring a high-density image formation at high speed. Further, in the ink jet print head 130 of this embodiment, since all the orifices are located at different positions in the subscan direction, the blank portion in the pixel forming area can be reduced in the subscan direction during the printing of a high-density image. This minimizes density variations appearing as lines that would otherwise be caused by the large blank portion in the pixel forming area. It is noted, however, that depending on the size of ink droplets, the orifices do not have to be located at different positions in the subscan direction and but may be arranged at the same positions in the subscan direction.

The print head 130 of this embodiment can be constructed to have the same number of orifices as that of the print head 40. This prevents the semiconductor board forming the print head from increasing in size. Further, the data processing such as image processing can be performed in the same way as in the conventional printing apparatus. All this combine to prevent an increase in cost and size of the ink jet printing apparatus.

It is noted that modifications can be made, as necessary, to what has been explained in this embodiment, such as the number of orifices, ink droplet volumes, ink colors, the relation between quantization levels and pixel patterns, and the number of printing scans performed to complete an image in a particular print area.

Fifth Embodiment

Next, a fifth embodiment of this invention will be explained.

In the fourth embodiment the print head has been described to have a plurality of orifice arrays. In this fifth embodiment the print head has arranged in a single array three kinds of orifices that eject ink droplets of different volumes, as shown in FIG. 20.

Figure 21:
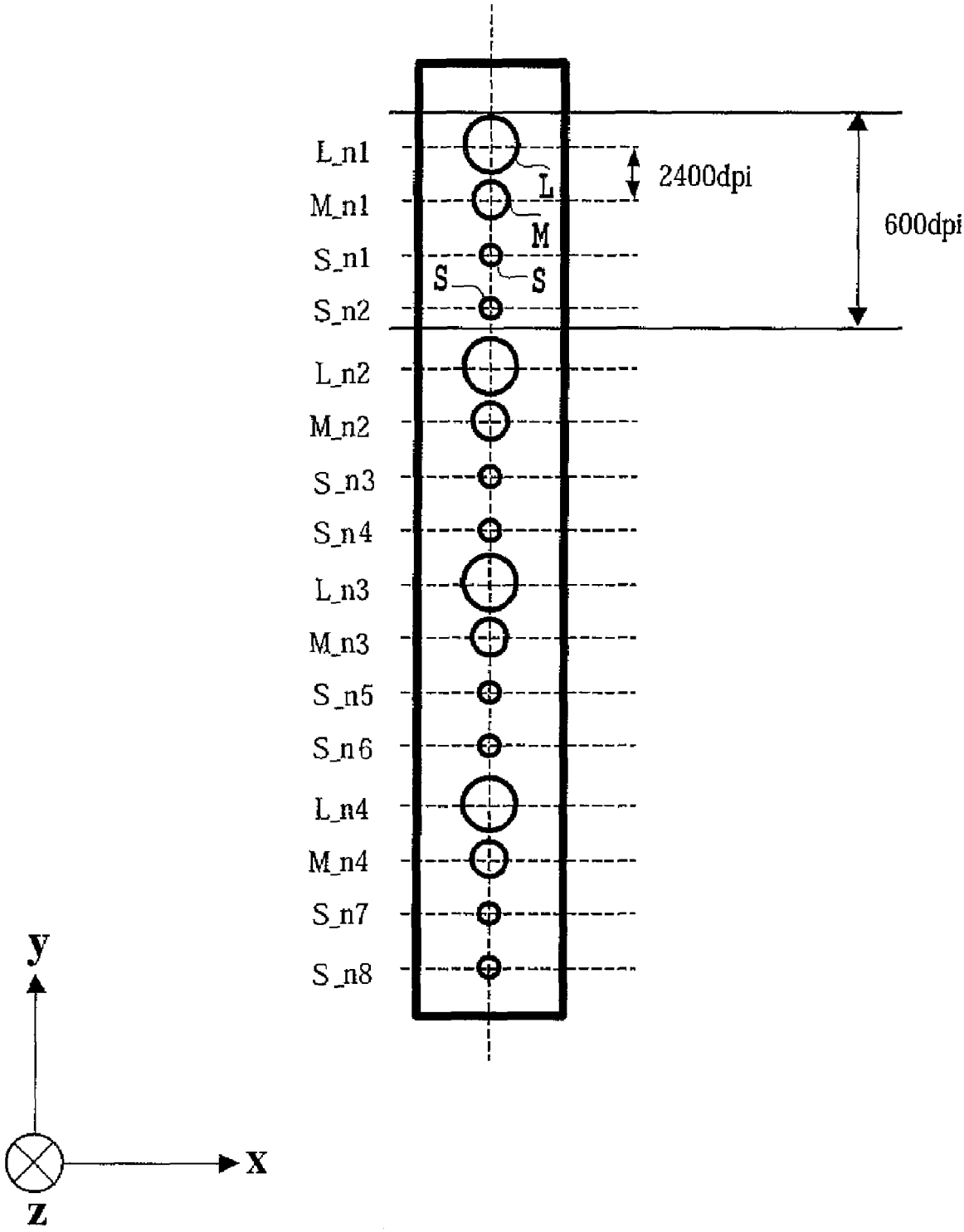
FIG. 21 is a schematic diagram showing a construction of a print head for comparison with the print head of the fifth embodiment of this invention.

In the print head 140 shown in FIG. 20, the orifices are arrayed in the subscan direction at intervals of 2400 dpi and, in every unit length (600 dpi) in the subscan direction, a large orifice L, a medium orifice M, a large orifice L and a small orifice S are arranged in that order. That is, in the unit length in the subscan direction, there are more large orifices L than there are orifices of any other kind. When compared with a virtual print head shown in FIG. 21, the print head of this embodiment can print each pixel forming area at high density and uniformly by the 1-pass printing.

Sixth Embodiment

Next, a sixth embodiment of this invention will be explained.

In the preceding embodiments, the ink jet print heads have been described to eject a single color ink (cyan ink). In this sixth embodiment the ink jet print head has a plurality of orifices to eject ink droplets of different colors.

Figure 22:
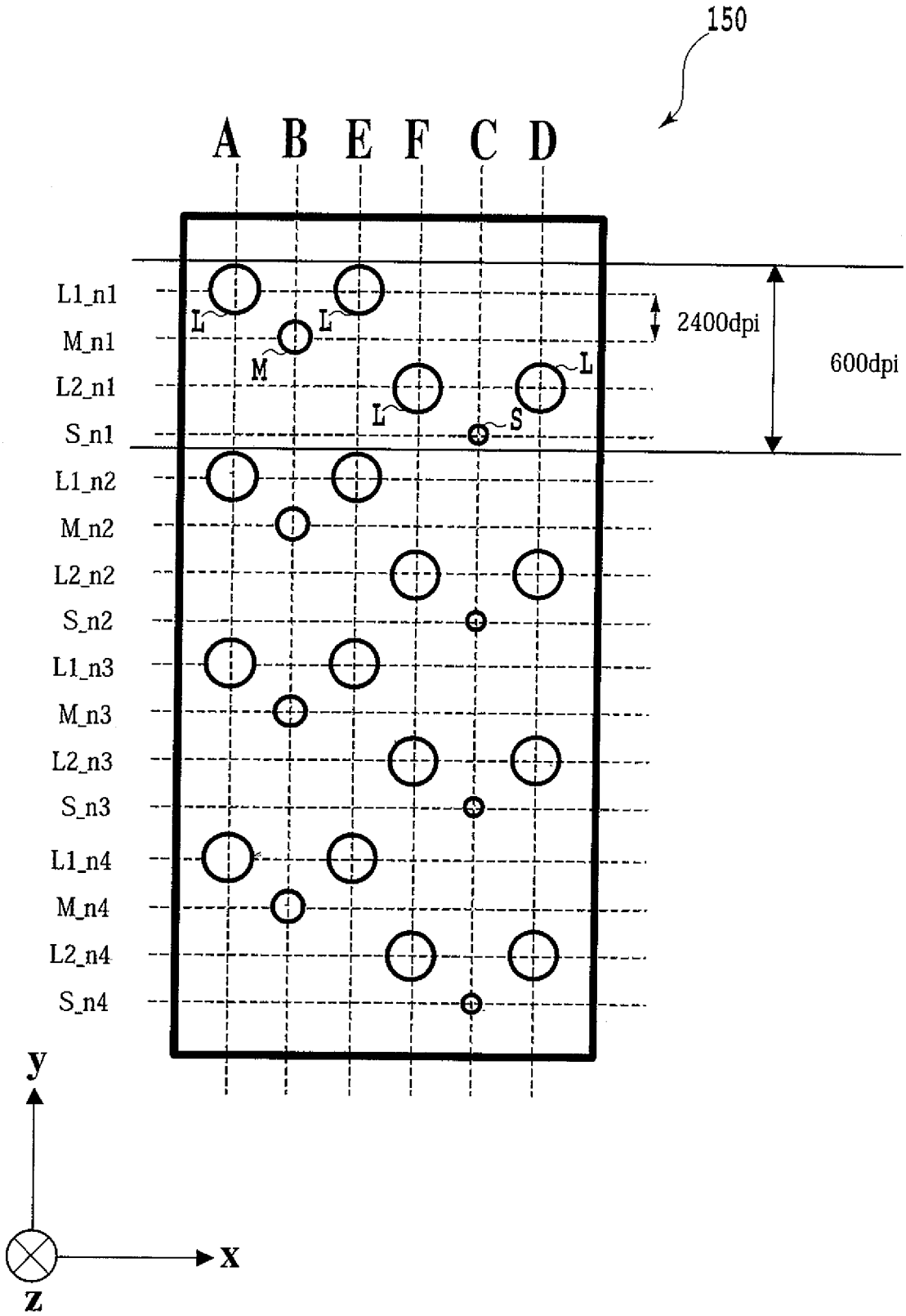
FIG. 22 is a schematic diagram showing a construction of a print head in a sixth embodiment of this invention.

FIG. 22 shows an arrangement of orifices in an ink jet print head 150 according to the sixth embodiment of this invention. The print head 150 is provided with six orifice arrays A, B, C, D, E, F each extending in the subscan direction (y direction), which are arranged side by side in the main scan direction. Each orifice array has n orifices arranged at a density of 600 orifices per inch (600 dpi). In the figure, only four orifices are shown as the orifices (n) making up each orifice array for a convenience sake.

Of the six orifice arrays, the orifice arrays A, B, C, D eject a cyan ink and the orifice arrays E, F eject a yellow ink.

The orifice arrays A, B, C, D adapted to eject a cyan ink have orifices of various kinds arranged at the same positions in the subscan direction as those in the print head of the fourth embodiment of this invention shown in FIG. 15. It is noted, however, that the arrangement of the orifice arrays in the main scan direction differs from that of the fourth embodiment. That is, the distance between the orifice array B made up of only the medium-diameter orifices M for ejecting cyan ink droplets and the orifice array C made up of only the small-diameter orifices S differs from that of the print head of FIG. 15. Between the orifice arrays B and C there are arranged orifice arrays E, F adapted to eject a yellow ink. The orifice arrays E, F are made up of only large-diameter orifices L adapted to eject 10-pl ink droplets.

In the FIG. 22, the positional relation in the subscan direction between the orifice arrays for ejecting a cyan color and the orifice arrays E, F for ejecting a yellow color is set as follows.

The orifices of the orifice array A (L1_n1 to L1_n4) and the orifice array E (L1_n1 to L1_n4) are arranged at the same positions in the subscan direction. The orifices of the orifice array D (L2_n1 to L2_n4) and the orifice array F (L2_n1 to L2_n4) are arranged at the same positions in the subscan direction.

The ink jet print head 150 of FIG. 22 are driven at the frequency of 15 kHz to eject ink droplets from its orifices. The print head 150 is moved in the main scan direction at the scan speed of 25 inches/sec. So, the printing is done by ejecting ink droplets at 600-dpi intervals in the main scan direction.

Figure 23:
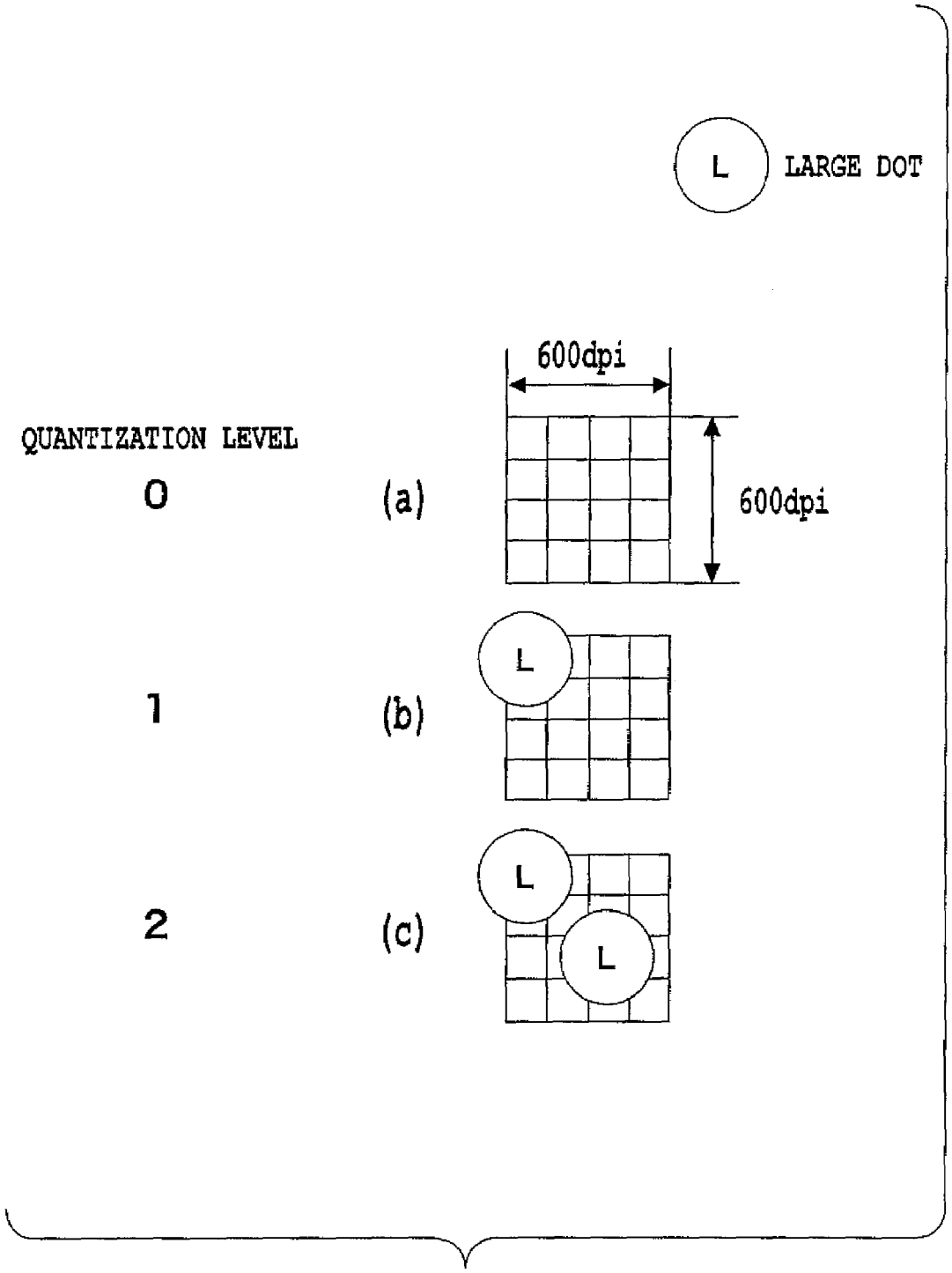
FIG. 23 shows a relation between a quantization level of yellow image data and a corresponding dot pattern formed when a 1-pass printing is executed using a yellow ink orifice array of the print head of the sixth embodiment of this invention.

FIG. 23 shows a relation between quantization levels of yellow image data and corresponding dot patterns when a 1-pass printing is performed using the yellow ink orifice arrays E, F of the print head 150.

As shown in FIG. 23, the density of each pixel with a resolution of 600×600 dpi is represented by one of three gradation levels specified by the quantization levels 0-2. More specifically, each pixel forming area is divided into a matrix of 4×4 segments, on which one kind of ink droplets (10 pl) are ejected to land, forming one of dot patterns (b), (c). A total of three dot patterns, including a no-dot pattern (shown in FIG. 23(*a*)) with no dots formed in the pixel forming area, represents three gradation levels specified by the quantization levels 0-2.

That is, the quantization level 0 corresponds to a no-dot pattern (shown in FIG. 23(*a*)). The quantization level 1 corresponds to a pattern (shown in FIG. 23(*b*)) in which one large dot of a 10-pl ink droplet is formed in one segment of the pixel forming area. The quantization level 2 corresponds to a pattern (shown in FIG. 23(*c*)) in which two large dots of a 10-pl ink droplet is formed in one segment. Therefore, the ink volume applied to the 600×600-dpi pixel forming area for each gradation level is 0 pl at quantization level 0, 10 pl at quantization level 1 and 20 pl at quantization level 2. In one main scan, since the number of dots that can be formed in each 600×600-dpi pixel forming area by each orifice of the orifice arrays E, F is one dot, the maximum ink volume applicable to each pixel forming area is 20 pl corresponding to the quantization level 2.

FIG. 24 shows a relation between a yellow ink volume applied to a 600×600-dpi pixel forming area according to a quantization level 1, 2 and a corresponding image density (optical density) when a 1-pass printing is performed using the orifice arrays E, F of the print head 150.

As shown in the figure, even if the yellow ink volume applied to the image forming area exceeds 20 pl, the resulting image density does not go higher than that when 20 pl of ink is applied. This means that the image density for the highly bright yellow color saturates when 20 pl of yellow ink is applied.

The relation between the quantization level of cyan image data and the corresponding dot pattern and the relation between the ink volume applied and the corresponding image density when a 1-pass printing is performed using cyan ink orifice arrays A-D are similar to those of the fourth embodiment.

For the cyan color, this embodiment uses three kinds of ink droplets of 10 pl, 2 pl and 0.5 pl to create five image densities corresponding to five quantization levels. For the yellow color, on the other hand, only one kind of ink droplet (10 pl) is used to create three image densities corresponding to three quantization levels. This may be explained as follows. The yellow color is brighter than the cyan color and its graininess in low gradation portions is less distinctive, making the yellow image density saturate with a smaller volume of ink applied to the pixel forming area. That is, if three levels of image density are created by using only one kind of ink droplets, it is possible to print a yellow image with as high a quality as a cyan image.

Figure 25:
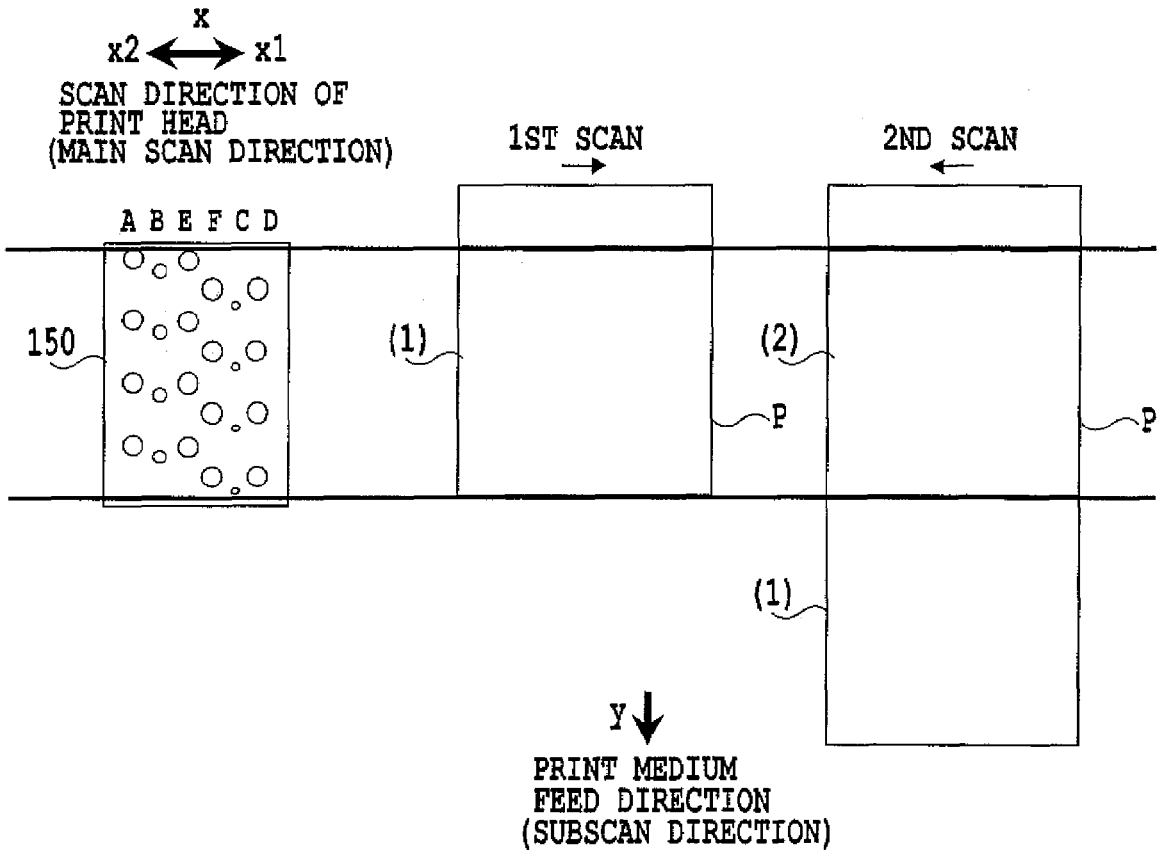
FIG. 25 illustrates how an image in a particular scan area is completed in two main scans by the print head of the sixth embodiment of this invention using two different color inks, cyan and yellow.

FIG. 25 shows how the print head 150 of this embodiment completes an image over a scan area in two main scans by using two different color inks, which are cyan and yellow. In a first main scan, the print head 150 is scanned in a forward direction (x1 direction) to print on an image area (1). At this time, the print head 150 ejects ink droplets from orifices in the order of orifice array D, orifice array C, orifice array F, orifice array E, orifice array B and orifice array A to print an image in the forward direction x1. Then, the print medium is fed in the subscan direction by 4/600 inches (16/2400 inches) equivalent to the total orifice width. Next, in a second main scan, the print head is scanned over an image area (2) to perform printing. At this time, the print head 150 ejects ink droplets from orifices in the order of orifice array A, orifice array B, orifice array E, orifice array F, orifice array C and orifice array D to perform printing in a backward direction (x2 direction) opposite the first main scan direction to complete the image. Then, the print medium is fed in the subscan direction by 4/600 inches (16/2400 inches) equivalent to the total orifice width, as when the first main scan is finished. A third and the subsequent main scans are performed in the same way as the first and second main scan.

Therefore, the order in which the cyan and yellow inks are printed in this embodiment is as follows. In the forward scan, the print head ejects a cyan ink from the orifice arrays D and C, followed by a yellow ink from the orifice arrays F and E, followed by a cyan ink from the orifice arrays B and A. In the backward scan, the print head ejects a cyan ink from the orifice arrays A and B, followed by a yellow ink from the orifice arrays E and F, followed by a cyan ink from the orifice arrays C and D.

As described above, the print head 150 of this embodiment ejects inks in the order of cyan, yellow and cyan at all times both during the forward scan and the backward scan. So, when the cyan ink and the yellow ink are printed overlappingly in the same area, the order in which the different color dots overlap during the forward scan is the same as that during the backward scan. That is, a yellow dot is applied over a cyan dot in both the forward scan and the backward scan, making the hue of the overlapping printed dots constant at all times regardless of the direction of scan. However, if two color dots should be printed overlappingly in different orders, the resulting hues of the overlapping dots would vary. This embodiment can solve this problem.

As described above, the print head of the sixth embodiment offers an advantage of being able to prevent color variations even if a two-way printing method capable of realizing a fast printing is performed. Further, as for the cyan ink, the print head has in the unit length (600 dpi) equal to the length of the pixel area two large orifices L, one medium orifice M and one small orifice S. That is, there are more large orifices than any other kind of orifices. Therefore, as in other embodiments, this embodiment enables a high-density, high-quality image with excellent gradation to be printed by the 1-pass printing.

The sixth embodiment has been described to adopt the relations employed in the fourth embodiment, i.e., the relation between the quantization level of image data and the dot pattern and the relation between the ink application volume and the image density. However, in a mode calling for a fast printing in particular, e.g., printing on plain paper, it is possible adopt the relations shown in FIG. 23 and FIG. 24, which are the relations between the quantization level and the dot pattern and between the ink application volume and the image density, to reduce the volume of image data and thereby increase the printing speed.

Seventh Embodiment

Next, a seventh embodiment of this invention will be explained. In the preceding embodiments the print heads have been described to eject only one ink or two color inks (cyan and yellow). It is noted, however, that this invention is also applicable to print heads that eject three or more color inks. In this seventh embodiment, a print head adapted to eject three color inks is described as an example.

Figure 26:
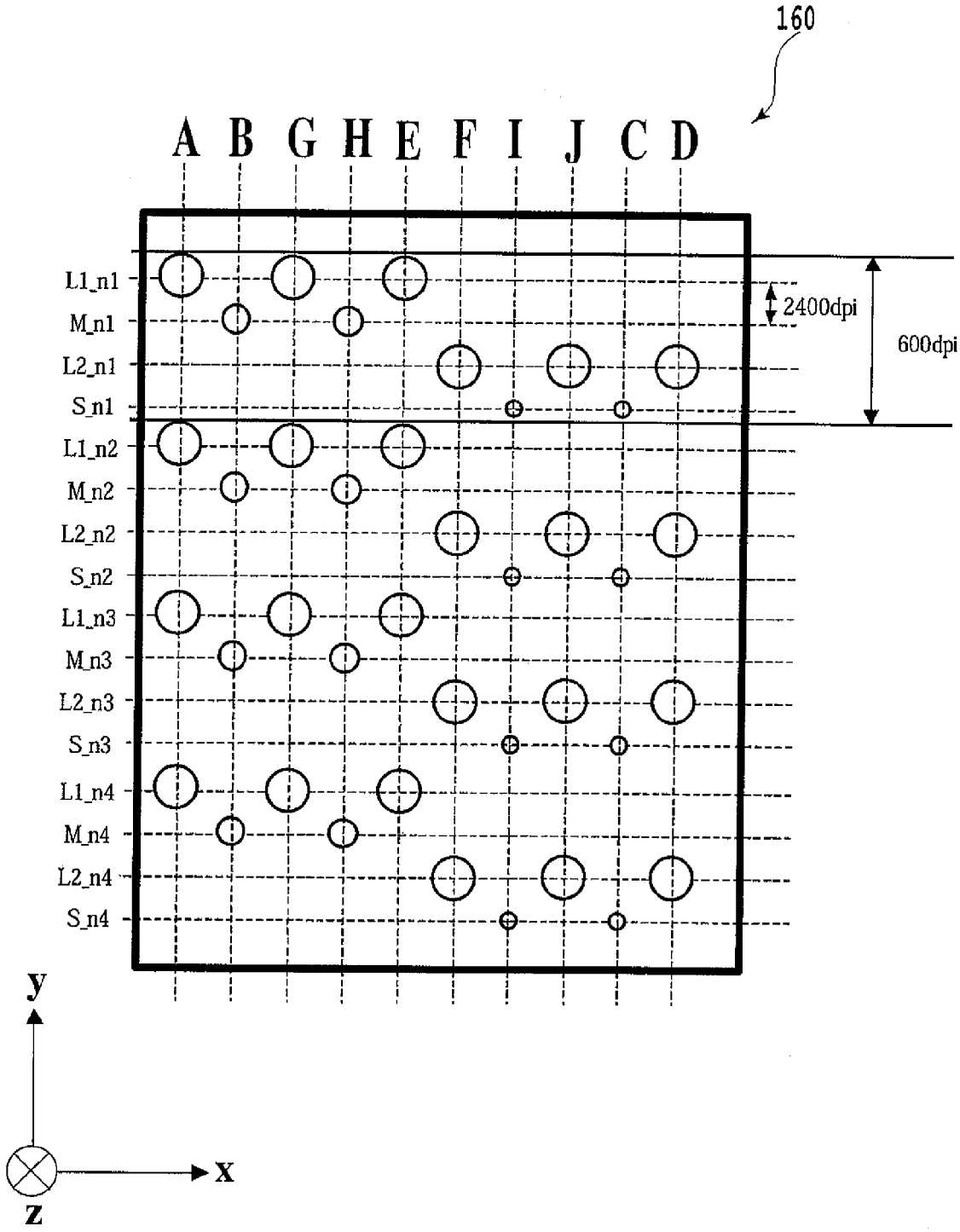
FIG. 26 is a schematic diagram showing a construction of a print head in a seventh embodiment of this invention.

FIG. 26 shows a print head having a plurality of orifices for ejecting a total of three color inks—cyan, yellow and magenta. The print head 160 has 10 orifice arrays A-J, of which the orifice arrays A-F are similar in construction to those of FIG. 22 with the same designations. That is, the orifice arrays A-D are adapted to eject a cyan ink and the orifice arrays E, F a yellow ink.

The orifice arrays G, H, I, J are adapted to eject a magenta ink and have the same constructions as those of the cyan ink orifice arrays. That is, the orifice array G is comprised of only large-diameter orifices for ejecting magenta ink droplets of 10 pl, with its individual orifices located at the same positions in the subscan direction as those of the orifice array A. The orifice array H is comprised of only medium-diameter orifices for ejecting magenta ink droplets of 2 pl, with its individual orifices located at the same positions in the subscan direction as those of the orifice array B. The orifice array I is comprised of only small-diameter orifices for ejecting magenta ink droplets of 0.5 pl, with its individual orifices located at the same positions in the subscan direction as those of the orifice array C. The orifice array J is comprised of only large-diameter orifices for ejecting magenta ink droplets of 10 pl, with its individual orifices located at the same positions in the subscan direction as those of the orifice array D.

The order in which color inks are printed by the print head 160 is as follows. First, in the forward scan, the print head ejects a cyan ink from the orifice arrays D, C, followed by a magenta ink from the orifice arrays J, I, followed by a yellow ink from the orifice arrays F, E, followed by a magenta ink from the orifice array H, G, followed by a cyan ink from the orifice arrays B, A. In the backward scan, the print head ejects a cyan ink from the orifice arrays A, B, followed by a magenta ink from the orifice arrays G, H, followed by a yellow ink from the orifice arrays E, F, followed by a magenta ink from the orifice array I, J, followed by a cyan ink from the orifice arrays C, D. As described above, inks are printed in the order of cyan, magenta, yellow, magenta and cyan in both the forward and backward scan. Therefore, where three different color inks are used and dots of different colors are printed overlappingly, the dot overlapping order is the same both in the forward and backward scan. This prevents the hue of the overlapping dots from changing according to the scan direction. Further, the magenta ink orifice arrays have in the unit length (600 dpi) equal to the length of the pixel area two large orifices L, one medium orifice M and one small orifice S, as do the cyan ink orifice arrays. That is, there are more large orifices L than any other kind of orifices. Therefore, as in other embodiments, this embodiment can print a high-density, high-quality image with excellent gradation by the 1-pass printing.

It is noted that the number of orifices, ink droplet volumes, ink colors and the relation between quantization levels and pixel patterns are not limited to those of the above embodiments.

The preceding embodiments have taken for example the ink jet print heads which are provided with orifices of different diameters to eject ink droplets of different volumes. This invention is also applicable to an ink jet print head that ejects ink droplets of different volumes from the orifices of the same diameter. For example, an ink jet print head may eject two or more kinds of ink droplets having different volumes from the same orifices by applying different electric energies to ejection energy generation elements that convert electric energy into ink ejection energy. Further, this invention is also applicable to an ink jet printing apparatus in which multiple kinds of ejection energy generation elements that produce different ejection energies are installed in each liquid path communicating with the associated ink ejection orifice and in which a desired kind of ejection energy generation element is selectively driven to change the number of ink droplets ejected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions This application claims the benefit of Japanese Patent Application No. 2006-162418, filed Jun. 12, 2006, which is hereby incorporated by reference herein in its entirety.

What is claimed is:

1. An ink jet print head that can eject a first ink and a second ink of a color which is different from a color of the first ink to a print medium while scanning the print medium in a first direction, the ink jet print head comprising:

a first orifice group in which orifices having a first diameter for ejecting the first ink are arranged at a predetermined pitch in a second direction crossing the first direction;

a second orifice group in which orifices having a second diameter for ejecting the first ink are arranged at the predetermined pitch in the second direction, the second diameter being smaller than the first diameter;

a third orifice group in which orifices having a third diameter for ejecting the first ink are arranged at the predetermined pitch in the second direction, the third diameter being smaller than the second diameter;

a fourth orifice group in which orifices having the first diameter for ejecting the first ink are arranged at the predetermined pitch in the second direction, the fourth orifice group being different from the first orifice group; and a fifth orifice group in which orifices for ejecting a second ink are arranged in the second direction;

wherein the first orifice group, the second orifice group, the fifth orifice group, the third orifice group and the fourth orifice group are arranged along the first direction in this order, and wherein each of the orifices of the first, second, third and fourth orifice groups is arranged at positions shifted in the second direction.

2. The ink jet print head according to claim 1, wherein each of the orifices of the fifth orifice group is arranged so as to overlap any one of orifices of the first and fourth orifice groups.

3. The ink jet print head according to claim 1, wherein the first ink is a cyan ink or a magenta ink and the second ink is a yellow ink.

4. An ink jet print head that can eject a first ink and a second ink of a color which is different from a color of the first ink to a print medium while scanning the print medium in a first direction, the ink jet print head comprising:

a first orifice group in which orifices having a first diameter for ejecting the first ink are arranged at a predetermined pitch in a second direction crossing the first direction;

a second orifice group in which orifices having a second diameter for ejecting the first ink are arranged at the predetermined pitch in the second direction, the second diameter being smaller than the first diameter;

a third orifice group in which orifices having a third diameter for ejecting the first ink are arranged at the predetermined pitch in the second direction, the third diameter being smaller than the second diameter;

a fourth orifice group in which orifices having the first diameter for ejecting the first ink are arranged at the predetermined pitch in the second direction, the fourth orifice group being different from the first orifice group; and a fifth orifice group in which orifices for ejecting a second ink are arranged in the second direction;

wherein the first orifice group, the second orifice group, the fifth orifice group, the third orifice group and the fourth orifice group are arranged along the first direction in this order, and wherein each of the orifices of the first, second, fourth and third orifice groups is arranged at positions shifted in the second direction in this order.

5. An ink jet print head that can eject a cyan ink, a yellow ink and a magenta ink to a print medium while scanning the print medium in a first direction, the ink jet print head comprising:

a first cyan orifice away in which orifices having a first diameter for ejecting the cyan ink are arranged at a predetermined pitch in a second direction crossing the first direction;

a second cyan orifice away in which orifices having a second diameter for ejecting the cyan ink are arranged at the predetermined pitch in the second direction, the second diameter being smaller than the first diameter;

a third cyan orifice away in which orifices having a third diameter for ejecting the cyan ink are arranged at the predetermined pitch in the second direction, the third diameter being smaller than the second diameter;

a fourth cyan orifice array in which orifices having the first diameter for ejecting the cyan ink are arranged at the predetermined pitch in the second direction, the fourth cyan orifice away being different from the first cyan orifice array;

a yellow orifice away in which orifices for ejecting the yellow ink are arranged in the second direction;

a first magenta orifice away in which orifices having the first diameter for ejecting the magenta ink are arranged at the predetermined pitch in the second direction;

a second magenta orifice away in which orifices having the second diameter for ejecting the magenta ink are arranged at the predetermined pitch in the second direction;

a third magenta orifice away in which orifices having the third diameter for ejecting the magenta ink are arranged at the predetermined pitch in the second direction; and a fourth magenta orifice array in which orifices having the first diameter for ejecting the magenta ink are arranged at the predetermined pitch in the second direction, the fourth magenta orifice array being different from the first magenta orifice array;

wherein the first cyan orifice array, the second cyan orifice array, the first magenta orifice array, the second magenta orifice array, the yellow orifice array, the third magenta orifice array, fourth magenta orifice array, third cyan orifice away and fourth cyan orifice array are arranged along the first direction in this order, wherein each of the orifices of the first, second, third and fourth cyan orifice arrays is arranged at positions shifted in the second direction; and wherein each of the orifices of the first, second, third and fourth magenta orifice arrays is shifted in the second direction.

* * * * *